US006533263B2

(12) United States Patent
Tamura

(10) Patent No.: US 6,533,263 B2
(45) Date of Patent: Mar. 18, 2003

(54) SHEET CONVEYING APPARATUS, AND IMAGE FORMING APPARATUS AND IMAGE READING APPARATUS HAVING SAME

(75) Inventor: Masashige Tamura, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 09/778,928

(22) Filed: Feb. 8, 2001

(65) Prior Publication Data

US 2001/0022422 A1 Sep. 20, 2001

(30) Foreign Application Priority Data

Feb. 15, 2000 (JP) ..... 2000-041411
Jan. 12, 2001 (JP) ..... 2001-005743

(51) Int. Cl.[7] ..... B65H 5/00

(52) U.S. Cl. ..... 271/10.01; 271/10.03; 271/10.11; 271/10.13; 271/110; 271/266; 271/270

(58) Field of Search ..... 271/10.01, 10.03, 271/10.09, 10.11, 10.13, 110, 116, 122, 270, 272, 258.03, 265.01, 266

(56) References Cited

U.S. PATENT DOCUMENTS 3,961,786 A * 6/1976 Yanker
4,522,385 A * 6/1985 Stefansson
5,397,107 A * 3/1995 Wolog et al.
5,415,387 A * 5/1995 Suzuki
5,996,993 A * 12/1999 Arikawa et al. ..... 271/258.01
6,076,821 A * 6/2000 Embry et al. ..... 271/10.01
6,260,840 B1 * 7/2001 Suga et al. ..... 271/10.12

* cited by examiner

*Primary Examiner*—David H. Bollinger
(74) *Attorney, Agent, or Firm*—Fitzpatrick, Cella, Harper & Scinto

(57) ABSTRACT

The present invention is made in consideration of the above circumstances, and an object of the present invention is to provide a sheet conveying apparatus which can monitor a sheet conveying condition even with small sheet interval, an image forming apparatus having such a sheet conveying apparatus, an image reading apparatus having such a sheet conveying apparatus, and a sheet processing apparatus having such a sheet conveying apparatus.

The present invention provides a sheet conveying apparatus that has detecting means for detecting each of the sheets to be conveyed, wherein, when the sheets are conveyed continuously, conveyance of a preceding sheet and a succeeding sheet is started in a condition that the succeeding sheet cannot be detected by the detecting means, and the preceding sheet and the succeeding sheet are conveyed in such a manner that a an interval which can be detected by the detecting means is created between the preceding sheet and the succeeding sheet at a position of the detecting means.

20 Claims, 31 Drawing Sheets

SHEET CONVEYING APPARATUS, AND IMAGE FORMING APPARATUS AND IMAGE READING APPARATUS HAVING SAME

BACKGROUND OF THE INVENTION

1. Field of the Invention

The present invention relates to a sheet conveying apparatus for conveying sheets one by one, and to an image forming apparatus or an image reading apparatus having such a sheet conveying apparatus, and more particularly, it relates to an arrangement for monitoring a conveying condition of sheets being continuously conveyed.

2. Related Background Art

As an example, a conventional image forming apparatus or image reading apparatus includes a sheet conveying apparatus comprising a sheet feeding portion for feeding out a sheet and a conveying portion for conveying the sheet fed out from the sheet feeding portion to an image forming portion or an image reading portion. In such a sheet conveying apparatus, it is required that a conveying condition of the sheet be monitored to ensure that the function of the image forming apparatus and the like having the sheet conveying apparatus is satisfied and that serious damage is avoided.

To this end, in the conventional sheet conveying apparatuses, for example, as shown in FIG. 32 which is a schematic view of the conveying portion, there is provided a sensor 104 of flag type for detecting a sheet 105 being shifted in a conveying direction e to monitor a condition that the sheet 105 is being conveyed through a sheet conveying passage, and, sheets 105 being conveyed continuously with predetermined or more interval (sheet interval) are detected by the sensor 104 of flag type. In other words, by detecting the sheet interval by means of the sensor 104 of flag type, the conveying condition of the sheet 105 is monitored.

Incidentally, FIG. 33 shows a construction of such a sensor 104 of flag type. In FIG. 33, the reference numeral 111 denotes a sensor flag; 112 denotes a photo-sensor ON/OFF of which is controlled as the sensor flag 111 is shifted; and 113 denotes a spring member. Incidentally, since the sensor flag 111 is biased by the spring member 113, if the sheet does not exist in the sensor portion, a condition shown in FIG. 33 is established.

When a sheet (not shown) conveyed in a direction shown by the arrow f between guide plates 115 abuts against the sensor flag 111, the sensor flag 111 is pushed by the sheet to be rocked around a fulcrum 114 in a direction shown by the arrow g. If the sensor flag 111 is rotated down in the direction g in this way, a signal from the photo-sensor 112 is changed, for example, from OFF to ON, with the result that a controlling device (not shown) detects the passage of the sheet.

By the way, when sheets are conveyed continuously, an amount of the sheet interval required for detecting the sheet positively by the sensor 104 of flag type is determined by a time period during which the sensor flag 111 is returned by the spring member 113 when the sensor flag 111 is changed from a condition that the photo-sensor 112 is blocked by the sensor flag to a condition that the photo-sensor is not blocked by the sensor flag, a time period until the flag position is stabled, and a time period until potential of the photo-sensor 112 is stabled.

FIG. 34 is a view showing a construction of a sheet feeding portion 1000 of the conventional sheet conveying apparatus. Sheets S stacked on a sheet stacking portion 1101 are fed and conveyed one by one to a conveying path H1100 by means of a pick-up roller 1102 which is started to be driven by sheet feeding command. The sheets S fed out by the pick-up roller 1102 enter into a nip portion between a retard roller 1103 and a sheet feeding roller 1104 which constitute separating means and feeding means, and, in the nip portion, only an uppermost sheet among the entered sheets is separated, and the separated sheet is conveyed to the downstream conveying path H1100.

When a plurality of sheets are conveyed, the retard roller 1103 is rotated in a direction opposite to the conveying direction by the action of a torque limiter (not shown) so that sheets other than the uppermost sheet are returned to the sheet stacking portion 1101. Incidentally, in FIG. 34, the reference numeral 1105 denotes a sheet end detecting sensor; and 1106 denotes a pair of pull-out rollers.

After a leading end of the fed sheet S is detected by the sheet end detecting sensor 1105, the sheet is transferred to the pair of pull-out rollers 1106 by which the sheet is pulled out from the nip portion between the sheet feeding roller 1104 and the retard roller 1103 and then is conveyed in the downstream direction.

In such a sheet feeding portion 1000, the sheets S being conveyed continuously are conveyed in such a manner that a predetermined or more distance (sheet interval) between a trailing end of a preceding sheet and a leading end of a succeeding sheet is provided to meet sheet conveying requirement from the image forming apparatus thereby to prevent inconvenience due to conveying delay of the sheet S. By detecting such sheet interval by the sheet end detecting sensor 1105, the conveying condition of the sheet S is monitored.

By the way, in some of sheet feeding portions 1000, so-called speed increase control is effected for the purpose that conveying control timings for the sheet become the same at each of sheet feeding stages having different lengths of conveying paths and that an image forming timing for a first sheet (first copy time in a copying machine) is hastened.

In such speed increase control, the sheet end detecting sensor 1105 is used as a pre-registration sensor, and a sheet feeding speed (conveying speed of the sheet obtained by the pick-up roller 1102 and the sheet feeding roller 1104) is maintained as it is, so that, after the sheet is detected by the pre-registration sensor, the sheet is temporarily stopped at a pre-registration stop position (which is effectively positioned behind the pair of pull-out rollers 1106 in order to stable the stop position) and then conveyance is re-started in a timed relationship thereby to realize stable conveyance, and, after the temporal stop, the re-conveying speed is made greater than the sheet feeding speed.

However, even when such control is effected, it is very important that the leading end of the sheet S is detected correctly by the sheet end detecting sensor 1105, and, to this end, it is required that the sheet interval be provided similar to the conveying portion shown in FIG. 32.

Further, in the sheet conveying apparatus, since skew-feed correction for aligning the posture and position of the sheet in front of the image forming portion or the image reading portion must be effected, in the past, various skew-feed correcting means (so-called registration means) have been proposed. Among them, there is means for effecting the skew-feed correction by temporarily stopping the sheet. In such skew-feed correction, greater sheet interval was required.

By the way, in a copying machine as an example of a conventional image forming apparatus of analogue type, even when continuous copying is effected after a single sheet (original) is read, an optical device for exposing the original must be reciprocated by times corresponding to the copy number, and, thus, the sheet interval is inevitably determined.

On the other hand, as image forming apparatuses and image reading apparatuses have been digitalized, by reducing the sheet interval to process the larger number of sheets within short time period, for example in case of image formation, substantial image forming speed has been enhanced without increasing a process speed of the image formation.

The reason is that, since the image reading and image formation are digitalized, after the original was once read, image information can be electrically coded and be stored in a memory, or, in the image formation, the information can be read out from the memory and an image corresponding to the image information of the original can be formed on a photosensitive member by means of an exposing apparatus such as a laser beam, an LED array or the like, with the result that, even when a plurality of sheets are copied, mechanical movement of an optical device and the like can be eliminated.

By the way, nowadays, in the image forming apparatus and the image reading apparatus (referred to as "image forming apparatus and the like" hereinafter), higher image quality and higher productivity have been requested.

For example, in the image forming apparatus, when the high image quality is requested, it is advantageous that the sheet is conveyed at a slow speed in the image forming portion, and, also in case of an image forming apparatus having a fixing portion for fixing the image, it is advantageous that the sheet is conveyed at a slow speed in the fixing portion. However, if the sheet is conveyed at the slow speed in this way, the productivity will be worsened.

Thus, in order to achieve high productivity while maintaining the high image quality, it is required that the distance between the sheets (sheet interval) must be made smaller. However, when a sensor of flag type is used as detecting means for monitoring the sheet being conveyed, as mentioned above, due to the returning time of the flag and the electrical response time of the photo-interrupter, the minimum sheet interval is required, thereby limiting the reduction of the sheet interval.

Incidentally, when an optical sensor such as a sensor of reflection type is used as means for solving this problem, although it is possible to reduce the sheet interval in comparison with the sensor of flag type, the optical sensor is more expensive than the sensor of flag type and cannot be used with a permeable sheet such as an OHP film.

SUMMARY OF THE INVENTION

The present invention is made in consideration of the above circumstances, and an object of the present invention is to provide a sheet conveying apparatus which can monitor a sheet conveying condition even with small sheet interval, an image forming apparatus having such a sheet conveying apparatus, an image reading apparatus having such a sheet conveying apparatus, and a sheet processing apparatus having such a sheet conveying apparatus.

The present invention provides a sheet conveying apparatus comprising detecting means for detecting each of the sheets to be conveyed, wherein, when the sheets are conveyed continuously, conveyance of a preceding sheet and a succeeding sheet is started in a condition that the succeeding sheet cannot be detected by the detecting means, and the preceding sheet and the succeeding sheet are conveyed in such a manner that a an interval which can be detected by the detecting means is created between the preceding sheet and the succeeding sheet at a position of the detecting means.

DESCRIPTION OF THE PREFERRED EMBODIMENTS

The present invention will now be fully explained in connection with embodiments thereof with reference to the accompanying drawings.

Figure 1:
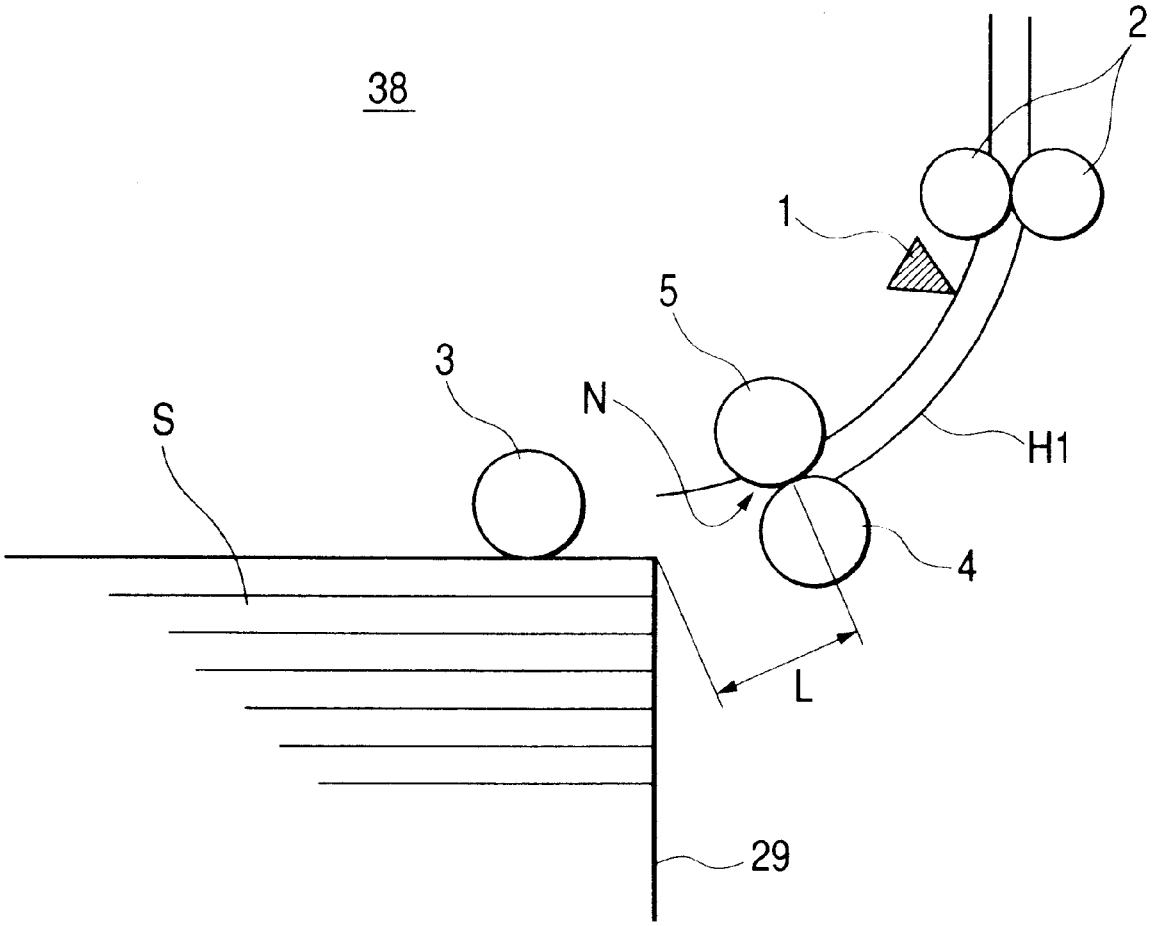
FIG. 1 is a schematic constructural view of a sheet feeding portion of a sheet conveying apparatus according to a first embodiment of the present invention.
Figure 2:
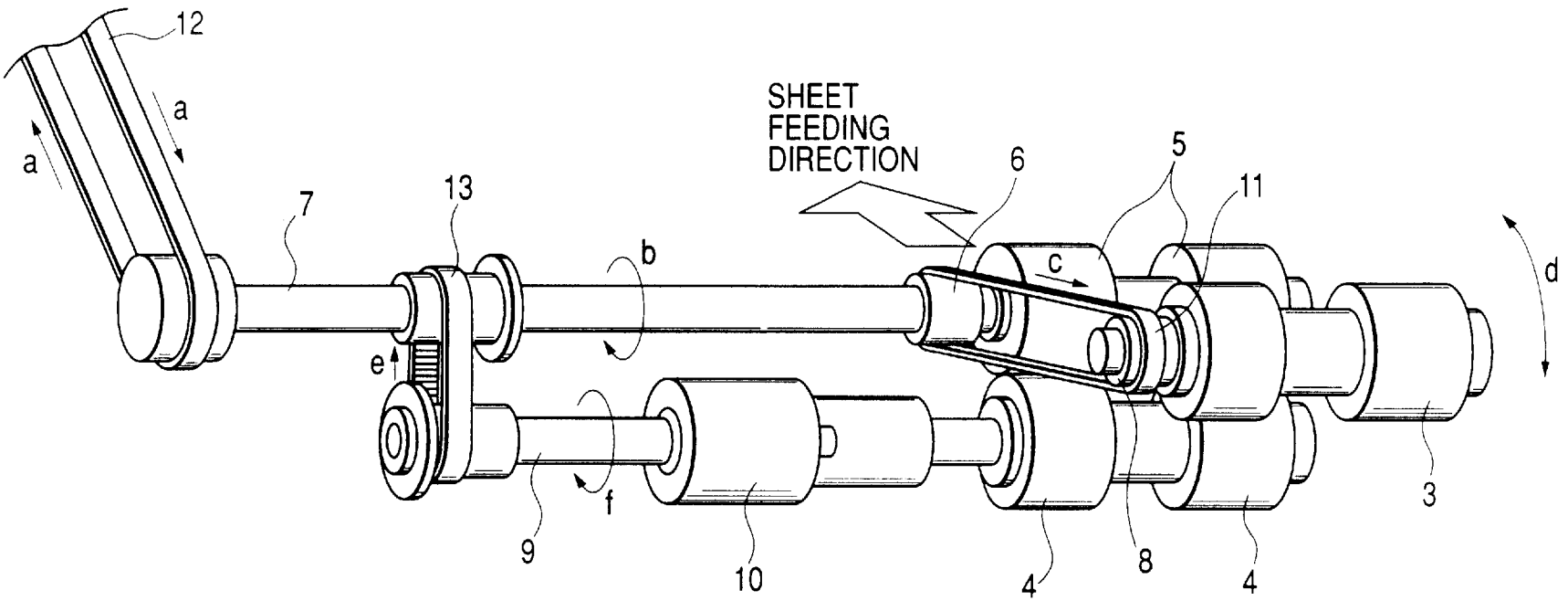
FIG. 2 is a perspective view for explaining a main schematic arrangement of a driving system of the sheet feeding portion.
Figure 3:
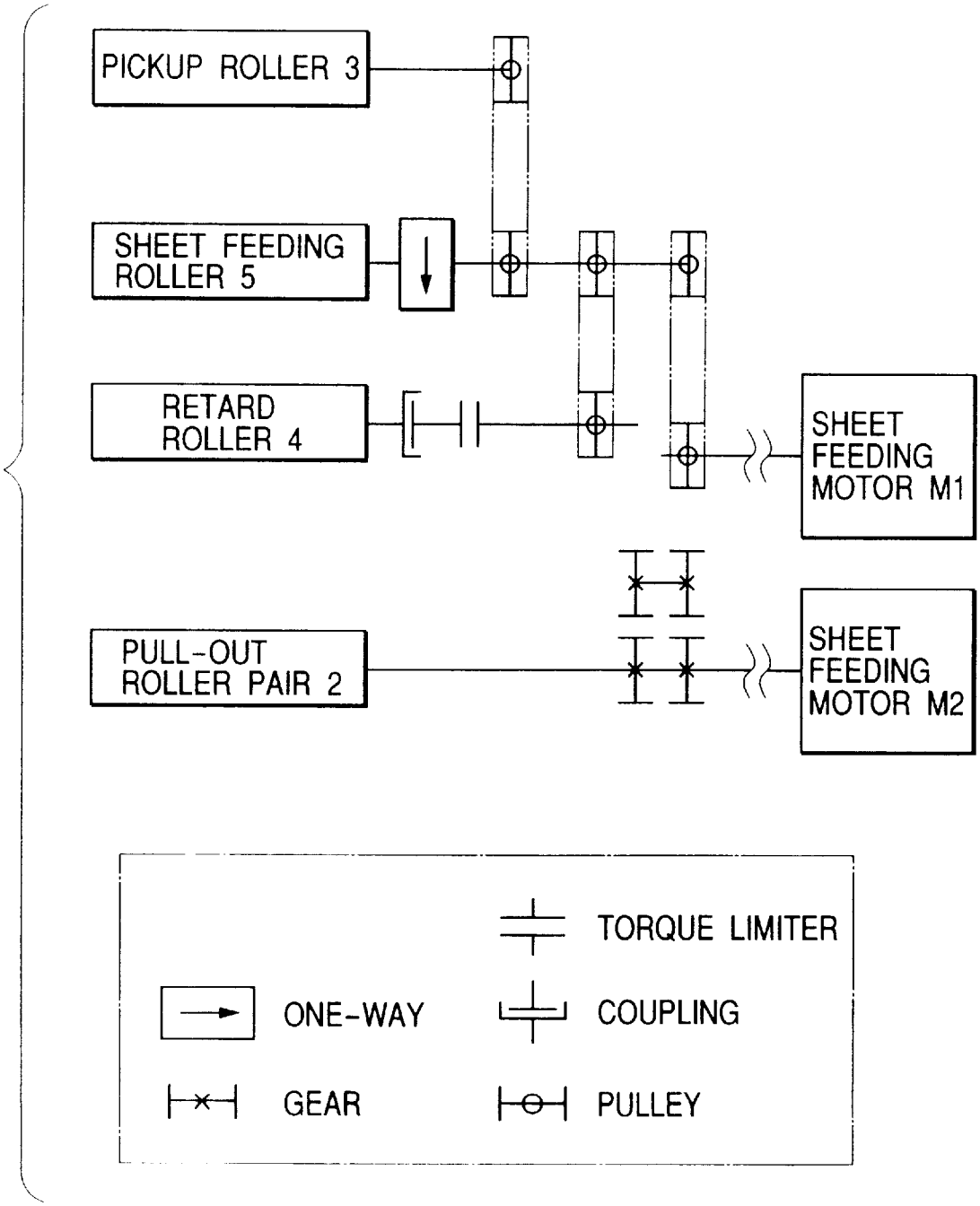
FIG. 3 is a block diagram of the driving system of the sheet feeding portion.
Figure 4:
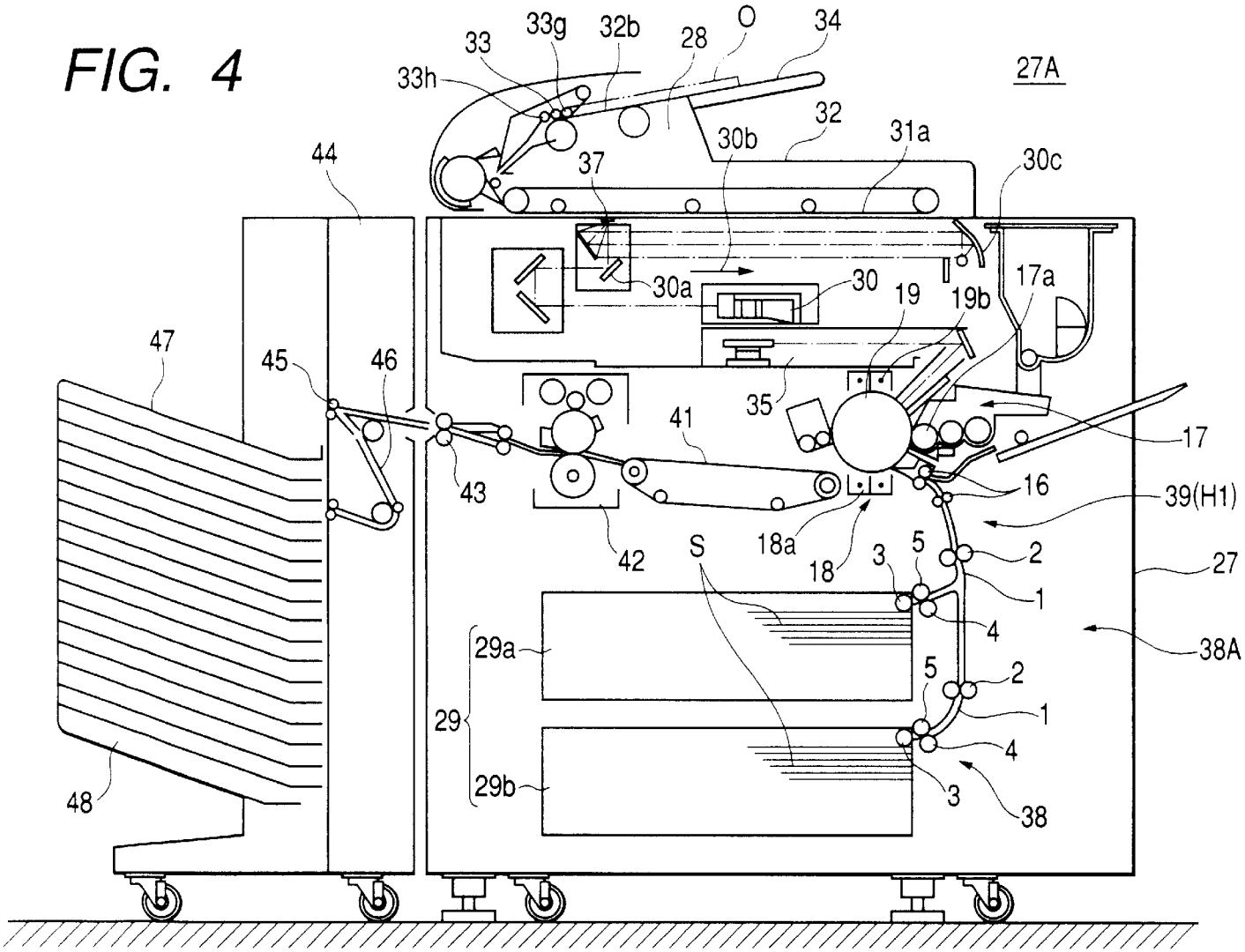
FIG. 4 is a view showing a schematic construction of an image forming apparatus having the sheet conveying apparatus according to the first embodiment.

FIG. 1 is a schematic constructural view of a sheet feeding portion of a sheet conveying apparatus according to a first embodiment of the present invention, FIG. 2 is a perspective view for explaining a main schematic arrangement of a driving system of the sheet feeding portion, FIG. 3 is a block diagram for explaining the driving system of the sheet feeding portion, and FIG. 4 is a view showing a main construction of an image forming apparatus having the sheet conveying apparatus according to the first embodiment.

In FIG. 4, the reference numeral 27A denotes a copying machine as an image forming apparatus; 27 denotes a main body of the copying machine; and 38A denotes a sheet conveying apparatus having a sheet feeding portion 38 and a conveying portion 39.

Returning to FIG. 1, in the sheet feeding portion, sheets S stacked in a sheet feeding cassette 29 as a sheet containing portion are fed and conveyed, one by one, to a conveying path H1 by means of a pick-up roller 3 as feeding means which starts to be driven in response to sheet feeding command.

The sheets S fed out by the pick-up roller 3 enter into a nip portion N between a retard roller 4 as a separating member and a sheet feeding roller 5 as a sheet feeding member, and, in the nip portion, only an uppermost sheet among the entered sheets is separated, and the separated sheet is conveyed to the downstream conveying path H1. The pick-up roller 3, the retard roller 4 and the sheet feeding roller 5 constitute separating means.

Incidentally, the sheet feeding roller 5 includes therein a one-way clutch as one-way connecting means, thereby permitting rotation of the sheet feeding roller in a sheet feeding direction. Further, when a plurality of sheets are conveyed, the retard roller 4 is rotated in a direction opposite to the conveying direction by the action of a torque limiter (not shown) so that the other sheets other than the uppermost sheet are returned toward the sheet feeding cassette 29.

There are further provided a sheet end detecting sensor 1 for detecting a leading end of the sheet S, and a pull-out roller (pair) 2 as conveying means. After the leading end of the fed sheet S is detected by the sheet end detecting sensor 1 as detecting means, the sheet is transferred to the pull-out roller pair 2 and then is pulled out from the nip portion N between the sheet feeding roller 5 and the retard roller 4 by the action of the pull-out roller pair 2. Thereafter, the sheet is conveyed to a downstream image forming portion.

As shown in FIGS. 2 and 3, the pick-up roller 3 is rotatably supported by a roller holder (not shown) rotatable around a sheet feeding roller shaft 7, and rotational movement thereof is transmitted from a driving pulley 6 attached to the sheet feeding roller shaft 7 to a driven pulley 8 provided in coaxial with the pick-up roller 3 through a drive transmitting belt 11, with the result that the pick-up roller 3 is rotated in synchronous with the rotation of the sheet feeding roller 7. A sheet conveying speed of the pick-up roller 3 is selected to be equal to that of the sheet feeding roller 5.

On the other hand, when the sheet S is pulled out from the sheet feeding roller 5 by stopping a sheet feeding motor M1 as driving means and by rotating the pull-out roller pair 2 which is driven independently from the sheet feeding roller 5 by rotational driving from a conveying motor M2 as another driving means, the one-way clutch does not transmit the rotational movement caused by the sheet feeding roller 5 to the sheet feeding roller shaft 7 and the pick-up roller 3, thereby preventing the unintended feeding operation.

During the sheet feeding operation, whenever the sheet is fed, the pick-up roller 3 is repeatedly operated to lift and lower by means of lifting/lowering means (not shown). In this way, the stacked sheets S are fed out one by one to the sheet feeding roller 5.

Further, the retard roller 4 is attached to a retard holder (not shown) rotatable around a rotary shaft (not shown). The rotational movement of the retard roller 4 is transferred toward a direction shown by the arrow e via a drive transmitting belt 13 and then to a retard shaft 9 supported by the retard holder, when the sheet feeding roller shaft 7 is rotated via the drive transmitting belt as mentioned above.

The retard shaft 9 is rotated in a direction d opposite to the sheet feeding direction. The retard roller 4 is attached to the retard shaft 9 via a torque limiter 10 which is idly rotated when a predetermined or more torque is applied, so that the plurality of sheets are prevented from being fed by the action of the torque limiter 10.

Next, a sheet conveying operation and an image forming sequence of the copying machine 27A will be explained.

First of all, the main body 27 of the copying machine is provided at its upper interior with a scanner portion 28 as image reading means for reading information on an imaged surface of a book original or a sheet-shaped original, and an image forming portion 17 as image forming means is disposed below the scanner portion 28, and the sheet conveying apparatus 38A to which the sheet feeding cassettes 29 (29*a*, 29*b*) are mounted is disposed below the image forming portion 17.

The scanner portion 28 comprises a scanning light source 30*c*, an original glass plate 31*a*, an original pressing plate 32 openable and closable with respect to the main body 27 of the copying machine, an automatic original feeding portion 33 integrally formed with the original pressing plate 32, an original discharge tray 34, mirror stage 30*a*, a light receiving portion 30 including a lens and a light receiving element (photo-electrical converting element), and an image processing portion.

The book original or the sheet-shaped original such as a book, a thick sheet or a curled sheet is rested on the original glass plate 31*a* with the imaged surface thereof facing downwardly and the original is kept in a stationary condition by pressing the back surface of the original by means of the original pressing plate 32. Then, when a reading start key on an operating panel (not shown) is depressed, the mirror stage 30*a* scans a lower portion of the original glass plate 31*a* in a direction shown by the arrow 30*b* in FIG. 4, thereby reading information on the imaged surface of the original.

The image information of the original read by light from the scanning light source 30*c* in the light receiving portion 30 is processed in the image processing portion (not shown) to be converted into an electrical signal which is in turn sent to a laser scanner 35.

The main body 27 of the copying machine acts as a copying machine when an image signal of the image reading means is inputted and acts as a printer when an output signal of a personal computer is inputted. Further, when a signal sent from other facsimile apparatus is inputted or when the image signal from the image reading means is sent to other facsimile apparatus, the main body of the copying machine acts as a facsimile apparatus.

Further, the automatic original feeding portion 33 serves to separate sheet-shaped originals 0 stacked on an original stacking plate 32*b* one by one and to convey the separated original to a sheet-shaped original reading portion 37. In reading the sheet-shaped original 0, the reading is effected in a condition that the mirror stage 30*a* is kept stationary below the sheet-shaped original reading portion 37. After the reading, the sheet-shaped original 0 is discharged onto an original discharge tray 34 by means of an original discharge roller 33*h* and a discharge sub-roller 33*g* which constitute sheet discharging means. Incidentally, in the illustrated embodiment, the original stacking plate 32*b* also serves as the original discharge tray 34.

On the other hand, the sheet feeding cassettes 29*a*, 29*b* are detachably mounted to the main body 27 of the copying machine below the image forming portion 17. The sheets S contained in the sheet feeding cassettes 29*a*, 29*b* are fed out by the pick-up roller 3 and are separated one by one by means of the sheet feeding roller 5 and the retard roller 4, and the separated sheet is directed into the conveying path H1 and is fed to an image transferring portion 18 by means of a conveying roller 16 and the like provided in the conveying path H1 in synchronous with the image forming operation.

In order to perform image formation in an electrophotographic manner, the image forming portion 17 includes a photosensitive drum 19, a laser scanner 35, a developing device 17*a* and a transfer charger 18*a*. By a laser beam corresponding to the image information and emitted from the laser scanner 35, a latent image is formed on a surface of the photosensitive drum 19 uniformly charged by a charging member 19*b*, and the latent image is changed to a toner image by the developing device 17*a*, and the toner image is transferred, by the transfer charger 18*a*, onto the first surface of the sheet S conveyed by the conveying roller 16 in synchronous with rotation of the photosensitive drum 19.

The reference numeral 41 denotes a conveying belt for conveying the sheet S on which the toner image was formed; 42 denotes a fixing apparatus; and 43 denotes a discharge roller. The sheet S on which the toner image was formed is conveyed, by the conveying belt 41, to the fixing apparatus 42, where the toner image is fixed to the surface of the sheet S by heat and pressure. Thereafter, the sheet is discharged, by the discharge roller 43, into a sorter device 44 disposed out of the copying machine.

The reference numeral 45 denotes a discharge sub-roller disposed in the sorter device 44; 46 denotes a vertical path portion; 47 denotes a discharge tray; and 48 denotes discharge bins. The sheet S conveyed in the sorter device 44 by the discharge roller 43 is conveyed by the discharge sub-roller 45 and is discharged onto the discharge tray 47. On the other hand, when a sort sheet discharging mode is set, the sheet S is passed through the vertical path portion 46 and then is discharged into the selected bin 48.

Next, characteristic sheet conveying control in the sheet feeding portion 38 of the sheet conveying apparatus 38A will be explained with reference to FIGS. 5 to 7A through 7D.

Figure 5:
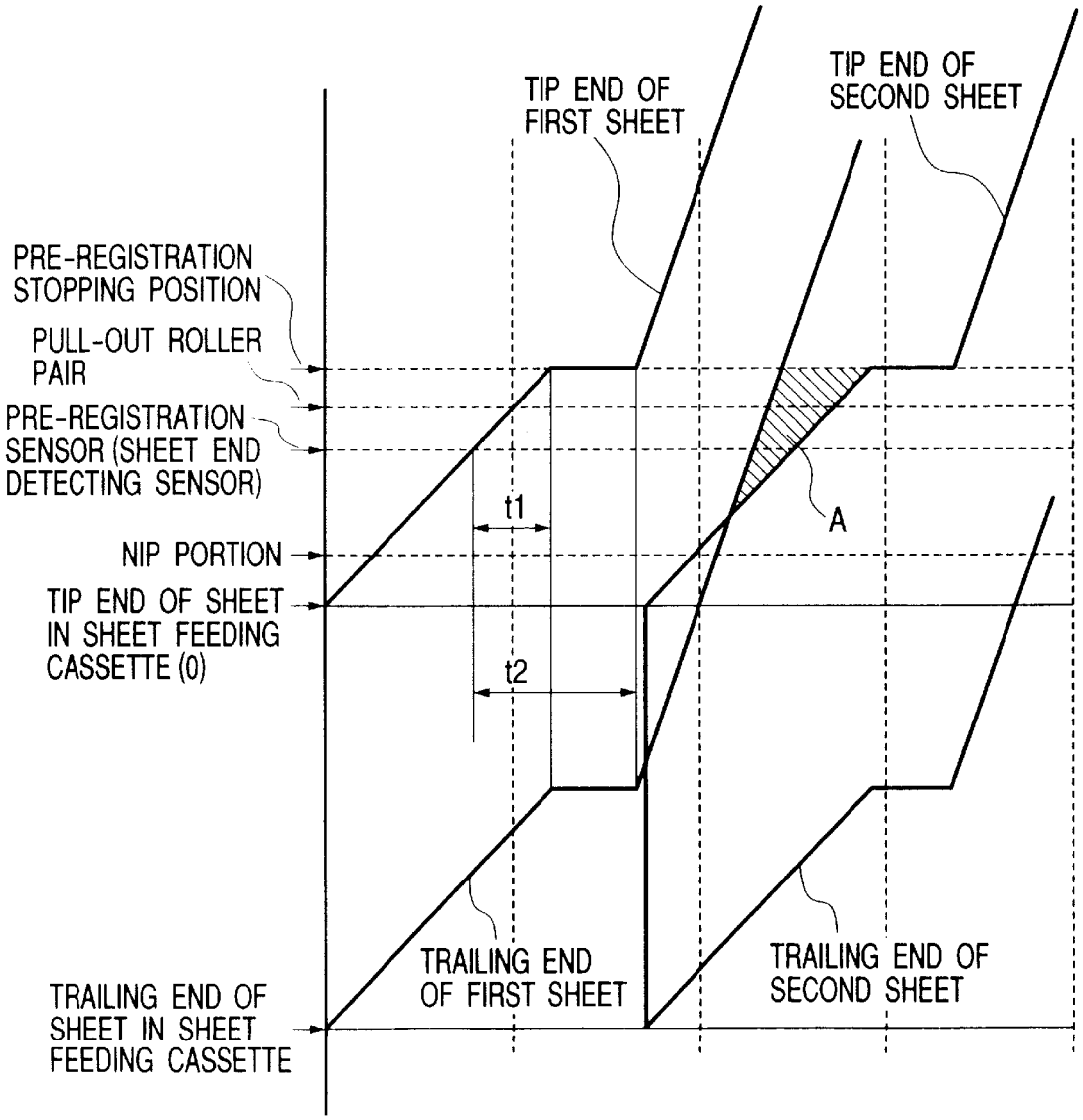
FIG. 5 is a timing chart in a uniform speed sheet feeding of the sheet feeding portion.
Figure 6:
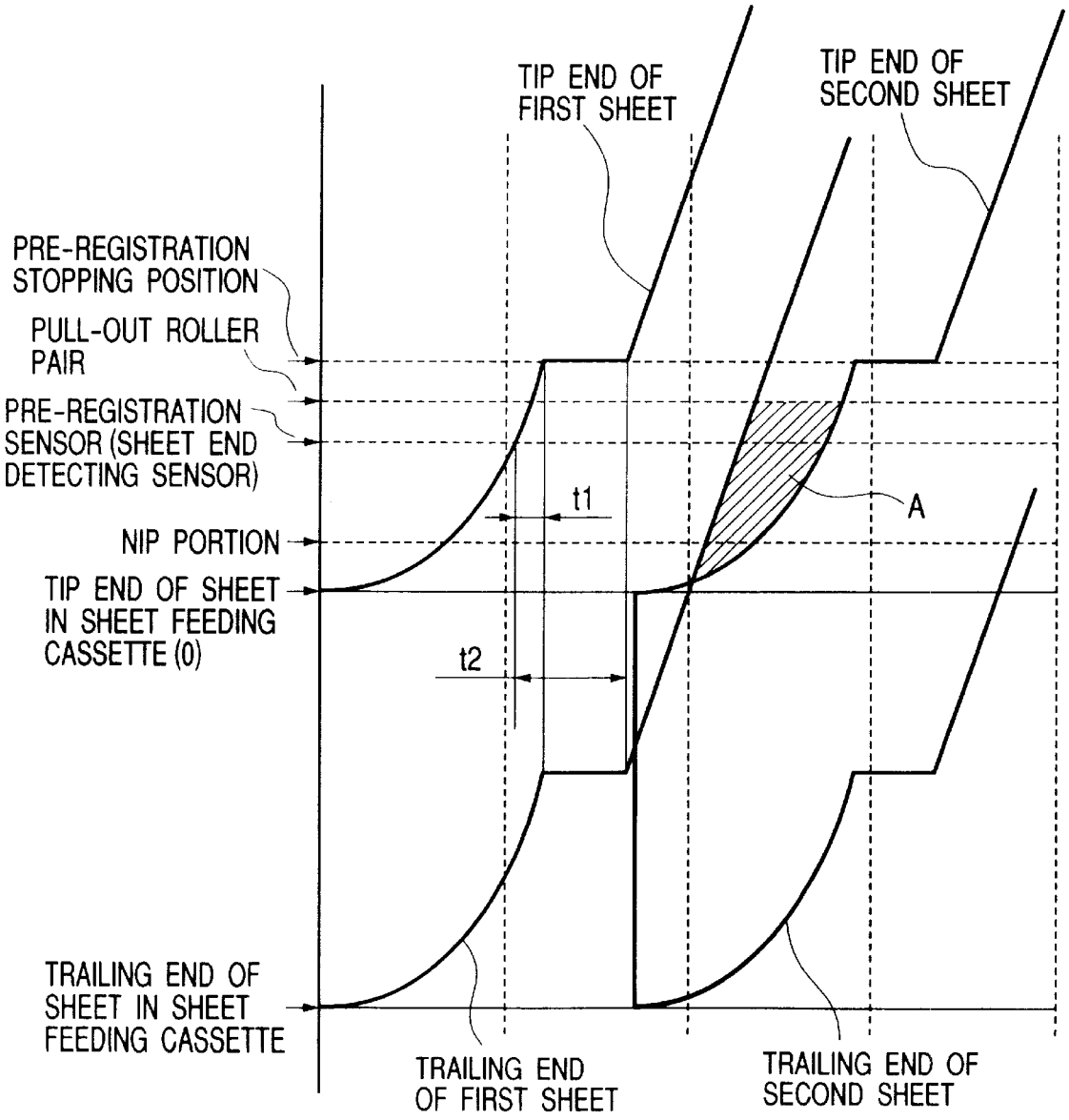
FIG. 6 is a timing chart in slow-up of the sheet feeding portion.

FIGS. 5 and 6 are timing charts of sheet conveyance and show a condition that two sheets are conveyed continuously. Incidentally, in FIGS. 5 and 6, the abscissa indicates "time" and the ordinate indicates "conveying distance in the sheet path", and positions of rollers and sensors are shown with assuming a leading end of the sheet in the sheet feeding cassette 29 (a sheet leading end position in the sheet feeding start) as a zero position.

In FIG. 5, a first upper oblique line shows a state that a first sheet S is being conveyed by the separating means at a first conveying speed, and a lower oblique line shows a state that a trailing end of the first sheet S is similarly conveyed from a trailing end position of the sheet in the sheet feeding cassette 29.

When the sheets S start to be conveyed, the leading ends of the sheets S firstly reach the nip portion N of the separating means and are separated one by one by means of the sheet feeding roller 5 and the retard roller 4, and the separated sheet is conveyed. Then, the leading end of the sheet is detected by the sheet end detecting sensor (pre-registration sensor) 1, control means or controller (not shown) starts count-up of a timer.

When the sheet S being conveyed exceeds the pull-out roller pair 2, since the count of the timer has a value indicating a desired timing (t1 in FIG. 5), the control means emits command for pre-registration stop of the sheet. After the sheet is temporarily stopped at a predetermined position in this way, by re-feeding the sheet at a predetermined timing, it is possible to stabilize the leading end registration timing of the sheet S to be fed to the main body 27 of the copying machine.

Incidentally, while the sheet is stopped, the control means does not effect the count-up of the timer. The reason is that the timing for receiving re-feeding command from the control means is varied with other scanner portion and fixing portion, and an operation preparing condition of a post-processing system, and, thus, such timing is not always constant.

Then, in dependence upon a wiring preparing timing, the control means emits re-feeding command for the sheet S. In this way, the sheet S is conveyed into the main body 27 of the copying machine. Meanwhile, the value of the timer becomes a sheet feeding timing (t2 in FIG. 5) for a next sheet S in the continuous sheet feeding, and the control means commands the sheet feeding start for the next sheet S.

As shown in FIG. 5, in the illustrated embodiment, upon sheet feeding of the next sheet, since the trailing end of the preceding sheet S still remains in the sheet feeding cassette 29, in the start of the sheet feeding, the trailing end of the preceding sheet S is overlapped with the leading end of the succeeding sheet S.

Since a sheet pulling-out speed (second conveying speed) of the pull-out roller pair 2 is sufficiently greater than a feeding speed (first conveying speed) of the pick-up roller 3 and the sheet feeding roller 5 (to create speed difference therebetween), a interval (sheet interval) will be created later between the trailing end of the preceding sheet S and the leading end of the succeeding sheet S.

In the illustrated embodiment, the sheet end detecting sensor (pre-registration sensor) 1 is provided in an area (in the conveying path H1 corresponding to a hatched area A in FIG. 5) where the sheet interval is generated.

By providing the sheet end detecting sensor 1 in the area where the sheet interval is generated, i.e., by widening the distance between the preceding sheet S and the succeeding sheet S at the position of the sheet end detecting sensor 1, even if there is no sheet interval between the preceding sheet and the succeeding sheet and these sheets are overlapped in the start of the sheet feeding, it is well possible to detect the leading end of the sheet being conveyed by means of a standard sensor (of flag type).

Incidentally, FIG. 5 shows a case where the rotations of the sheet feeding roller 5 and the pick-up roller 3 are started by using a clutch in a transmitting path (omitted in FIG. 3) for rotational movement from the sheet feeding motor M1 and by engaging the clutch after the sheet feeding motor M1 is previously rotated, i.e., a case where the sheet feeding is started at a uniform speed (uniform speed sheet feeding).

On the other hand, in FIG. 6, since any clutch is not used in a transmitting path (omitted in FIG. 3) for rotational movement from the sheet feeding motor M1 and the sheet feeding roller 5 and the pick-up roller are directly connected to the sheet feeding motor M1 to effect control for gradually increasing the number of revolutions of the sheet feeding motor M1, the numbers of revolutions of the sheet feeding roller 5 and the pick-up roller 3 are also gradually increased. That is to say, the sheet feeding speed is gradually increased (such a sheet feeding system is referred to as "slow-up sheet feeding" hereinafter).

In this case, even in the same productivity (the same number of feeding sheets per unit time), since the speed of the sheet is reduced when the sheet enters into the nip portion N between the sheet feeding roller 5 and the retard roller 4, if conditions (retard pressure and returning force of the torque limiter) are the same, it is advantageous regarding separability. Incidentally, the effect according to the illustrated embodiment are not changed not only in the uniform sheet feeding but also in the speed increase (slow-up) sheet feeding.

Next, an actual movement of the sheet will be explained with reference to FIGS. 7A to 7D.

Figure 7A:
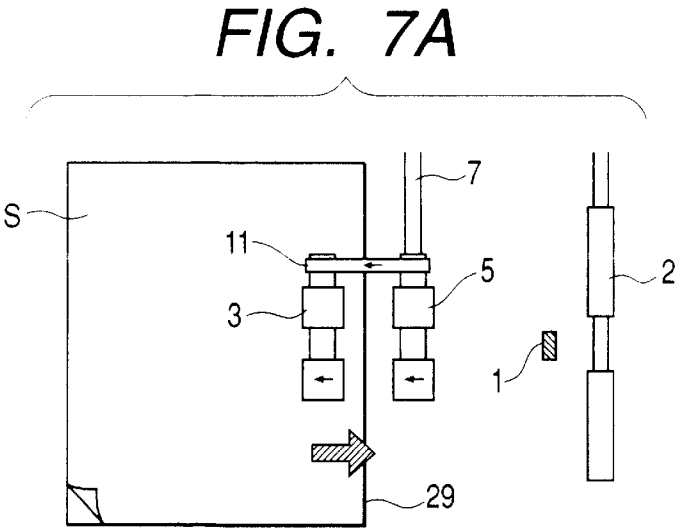
FIGS. 7A, 7B, 7C and 7D are views for explaining a sheet conveying condition of the sheet feeding portion.

As shown in FIG. 7A, the sheets S are contained in the sheet feeding cassette. When the sheet feeding rotational force is transmitted to the sheet feeding roller, the rotational force rotates the sheet feeding roller 5 and is transmitted to the pick-up roller 3 via the drive transmitting belt 11, thereby rotating the pick-up roller. In this case, the respective rotational speeds are smaller than the conveying speed in the image forming apparatus.

Figure 7B:
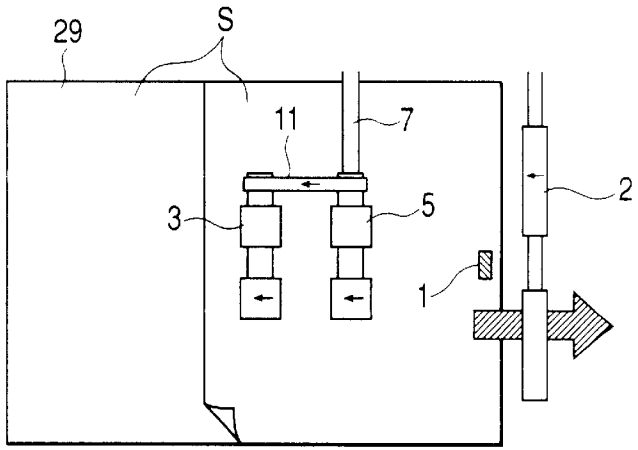

After the sheet S reaches the sheet feeding roller 5, the control means emits "up request" for the pick-up roller 3, with the result that the pick-up roller 3 is separated from the sheet S. Then, as shown in FIG. 7B, the sheet S fed out by the pick-up roller 3 and conveyed by the sheet feeding roller 5 is passed through the sheet end detecting sensor (pre-registration sensor) while increasing its conveying speed. In this case, the sheet end detecting sensor 1 which detected the leading end of the sheet S being conveyed informs the control means of the fact that the sheet is conveyed.

Figure 7C:
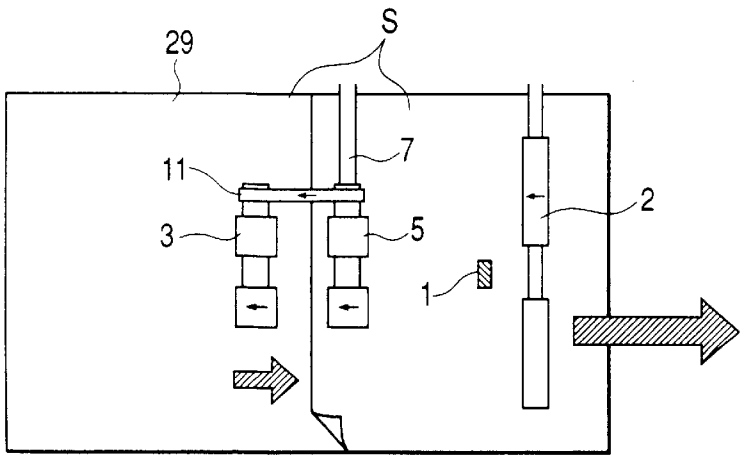

Then, the sheet S temporarily stopped at the pre-registration stop position is pulled out by the pull-out roller pair 2 in response to re-feeding command from the control means and starts to be conveyed at a speed greater than the sheet feeding speed (FIG. 7C). When the sheet is conveyed by the pull-out roller pair 2, since the driving force is not applied to the sheet feeding roller shaft 7, the sheet is conveyed only by the conveying force of the pull-out roller pair 2.

By the way, in case of continuous sheet feeding, since the next sheet S starts to be fed in this point, the sheet feeding roller shaft 7 starts to be rotated gradually at the sheet feeding speed. Here, although the sheet feeding speed is sufficiently slower than the conveying speed of the sheet feeding roller 5 given by the sheet S being pulled out by the conveying force of the pull-out roller pair 2, due to the presence of the above-mentioned one-way clutch mechanism, idle rotation is generated between the sheet feeding roller shaft 7 and the sheet feeding roller 5, with the result that the sheet feeding roller shaft can be rotated only by the feeding (sheet feeding) speed of the pick-up roller 3 (FIG. 7C).

Figure 7D:
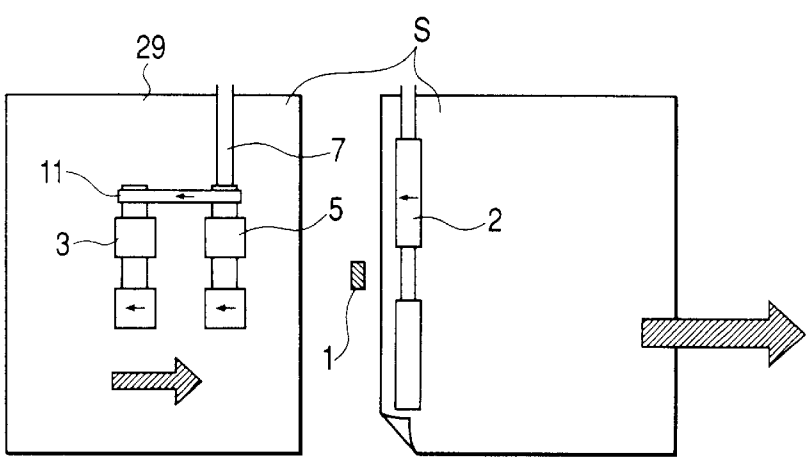

As a result, a speed difference is generated between the preceding sheet S being pulled out and the succeeding sheet S being fed, with the result that, as shown in FIG. 7D, the sheet interval is generated between the preceding sheet S and the succeeding sheet S, and, thus, the leading end of the succeeding sheet S can be detected by the sheet end detecting sensor 1.

Incidentally, when the preceding sheet S leaves the sheet feeding roller portion 5 (nip portion N), the one-way clutch mechanism is engaged, with the result that the preceding sheet S can start to be conveyed at a speed synchronous with the pick-up roller 3. Incidentally, this time, while the speed increase (slow-up) sheet feeding was explained, also in the uniform sheet feeding, similar conveyance is effected.

Next, the control means (controller) in the illustrated embodiment will be explained with reference to FIGS. 8 and 9.

Figure 8:
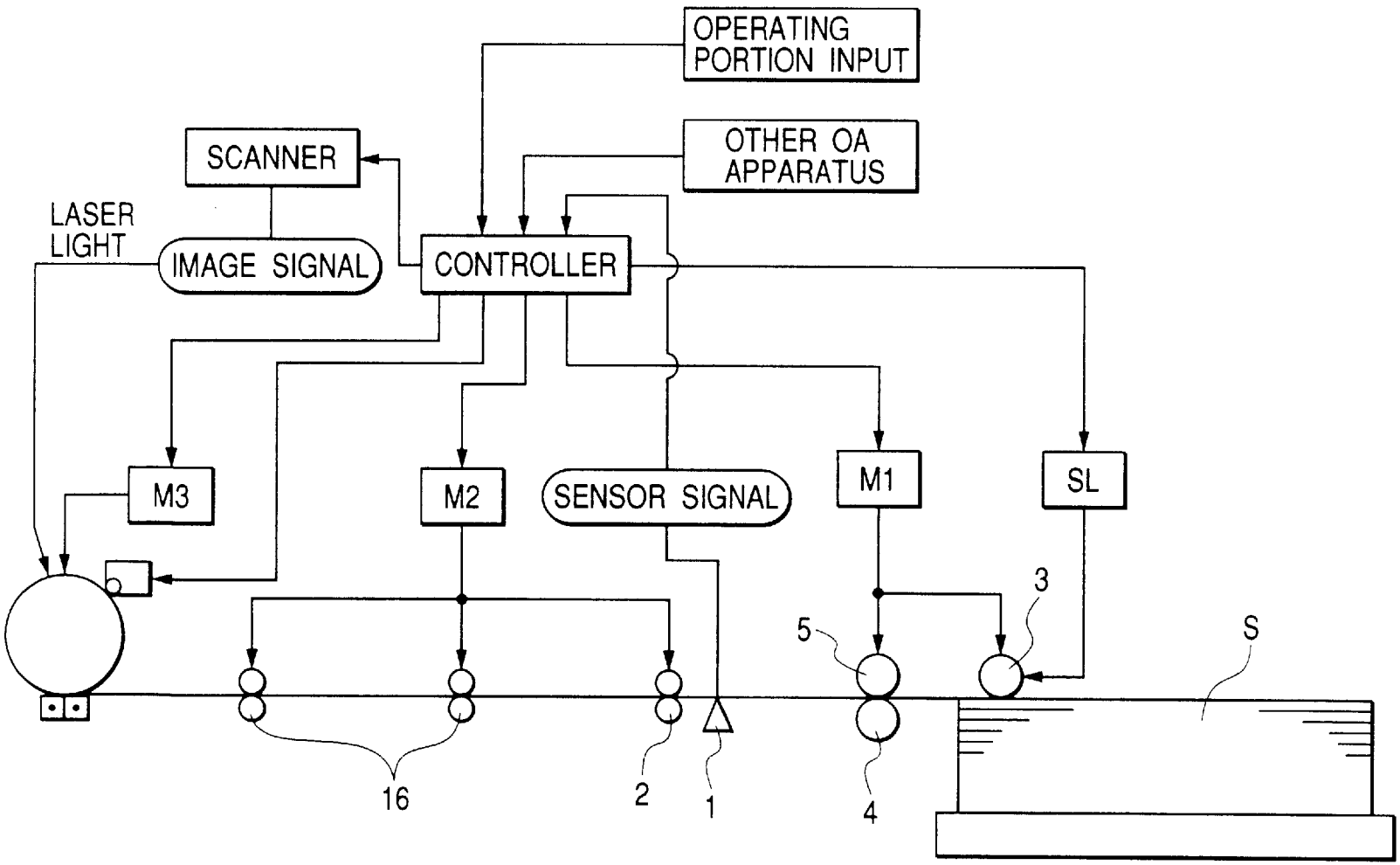
FIG. 8 is a control block diagram of the sheet conveying apparatus.
Figure 9:
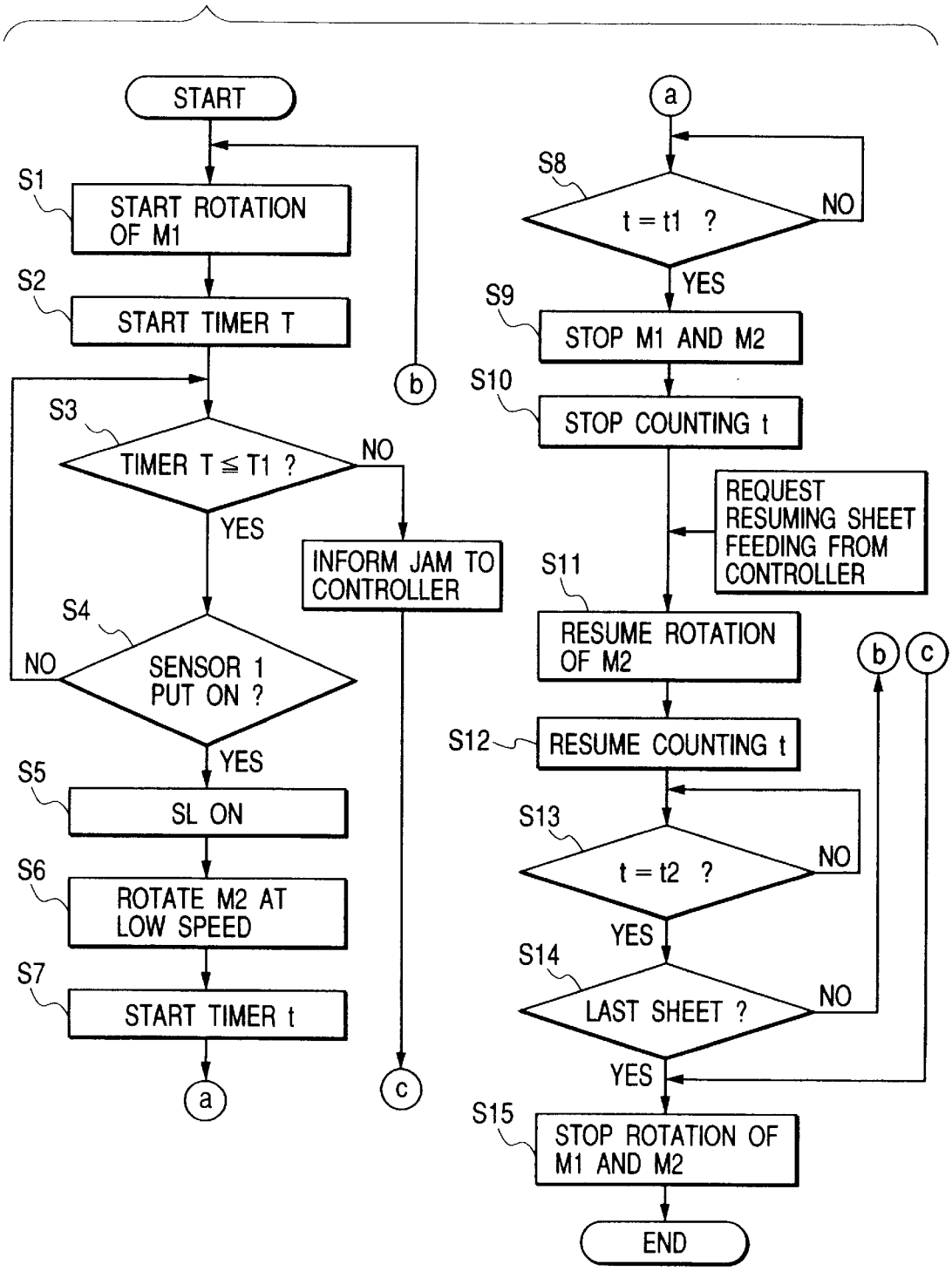
FIG. 9 is a flow chart for explaining an operation of the sheet conveying apparatus.

FIG. 8 is a block diagram mainly showing electrical parts associated with a control system of the copying machine 27A including the sheet conveying apparatus 38A according to the illustrated embodiment, and FIG. 9 is a flow chart for explaining control of the sheet feeding apparatus 38 in the illustrated embodiment.

When output command is emitted from the operating portion or other OA equipment, the control means (shown as the controller) turns the sheet feeding motor M1 ON (Step 1). At the same time, the control means starts count-up of a timer T (Step 2).

As mentioned above, the rotational driving force is given to the pick-up roller 3, sheet feeding roller 5 and retard roller 4 by the rotation of the sheet feeding motor M1, with the result that the pick-up roller 3 and the sheet feeding roller 5 are rotated in the feeding direction, and the retard roller 4 subjected to reverse rotation input is rotated in the feeding direction in opposition to the torque limiter 10 by the friction force against the sheet feeding roller 5 in the nip portion N.

The sheets S fed by this action are separated one by one by means of the sheet feeding roller 5 and the retard roller 4, and the separated sheet reaches the sheet end detecting sensor 1 as the pre-registration sensor (Step 4).

Meanwhile, the control means monitors the count of the timer T. If a value of the timer T indicates T≧T1 due to sheet feeding trouble or conveying trouble, i.e., if the value of the timer T exceeds a predetermined value T1, it is judged as sheet jam, and the jam occurrence is transmitted to the control means, thereby finishing the conveying operation (Step 3). Incidentally, the value T1 is defined as T1=Tr+Tj by using a theoretical value Tr in which the leading end of the sheet is assumed to be theoretically detected by the sheet end detecting sensor 1 and a predetermined jam margin value Tj.

In a case where here is no sheet feeding trouble and conveying trouble and the sheet S is correctly conveyed, when the leading end of the sheet S is passed through the sheet end detecting sensor 1, the control means emits command for turning a solenoid SL ON in order to separate the pick-up roller 3 from the surface of the sheet S (Step 5).

As the same time, since the control means emits command for rotating the conveying motor M2, the pull-out roller pair 2 starts to be rotated (Step 6). The number of revolutions in this case is not so great because it is matched to the speed of the sheet S being sent. That is to say, the conveying motor M2 is rotated at a low speed.

Further, when the leading end of the sheet S is detected by the sheet end detecting sensor 1, the control means starts count-up of a new timing measuring timer t (Step 7). Incidentally, in this case, by the rotation of the conveying motor M2, the pull-out roller pair 2 and plural conveying roller pairs 16 are rotated at predetermined speeds.

When the sheet S transferred to the plural conveying roller pairs 16 exceeds the pull-out roller pair 2 and reaches the predetermined pre-registration stop position and a value of the timer t becomes t1, the control means commands the stop of the sheet feeding motor M1 and the conveying motor M2, thereby temporarily stopping the sheet S (Step 8, Step 9).

At the same time, the control means also stops the count-up of the timer t (Step 10). The reason is that, as mentioned above, the timing for receiving the re-feeding command from the control means is varied with other scanner portion and fixing apparatus and the operation preparing condition of the post-processing system and is not constant.

When the feeding re-start command is received from the control means, only the conveying motor M2 re-starts to be rotated, with the result that the sheet S starts to be pulled out from the nip portion between the sheet feeding roller 5 and the retard roller 4 (Step 11). The conveying speed in this case is sufficiently greater than the rotational speed of the pull-out roller pair 2 at the initiation of rotation thereof. At the same time, the control means re-starts the count-up of the timer t (Step 12).

The control means monitors the value of the timer t. When the value of the timer t reaches t2 (t=t2), the control means judges whether the condition is under continuous feeding or under last feeding. If under the continuous feeding, the control means commands the feeding re-start of the next sheet (Step 13, Step 14). That is to say, in case of the continuous feeding, when t=t2 is established, another task starting from the Step 1 is started.

If the conveyance is continued, since the sheet interval is generated after the preceding sheet S by the speed difference between the conveying speed of the pull-out roller pair 2 and the conveying speed of the sheet feeding roller 5/retard roller 4 pair, the nest sheet S conveyed by the sheet feeding roller 5 enters into the sheet end detecting sensor 1 which can now detect the sheet. With this arrangement, even in the condition that there is no sheet interval at the initiation of the sheet feeding, during the continuous sheet feeding, the leading end of the sheet can be detected, thereby ensuring the stable continuous sheet feeding ability.

Incidentally, in the Step 14, if the sheet is the last sheet or if emergency stop such as jam occurs, the control means stops the rotations of the sheet feeding motor M1 and the conveying motor M2, thereby finishing the sheet feeding task (Step 15). Thereafter, the sheet S conveyed into the main body 27 of the copying machine is subjected to registration control for synchronizing the toner image on the photosensitive drum 19 with the sheet S. In this way, the toner image is transferred onto the sheet.

The image signal is recorded on the photosensitive drum 19 as the latent image by the laser beam emitted from the laser scanner 35. The latent image recorded on the photosensitive drum 19 is developed as the toner image in the image forming portion 17. Incidentally, in this explanation, while the slow-up sheet feeding was exemplified, it should be noted that, in the light of principle of the present invention, the same effect can be achieved also in the uniform speed sheet feeding so long as the control is effected at sufficiently greater than the sheet feeding speed.

Incidentally, in the illustrated embodiment, while an example that the retard roller is used as the separating means was explained, other separating system such as a separation pad may be used. Incidentally, in the conveyance using the separation pad, since the preceding sheet and the succeeding sheet cannot be conveyed while partially overlapping them, the sheet is fed out with zero interval which cannot be detected by the detecting sensor.

Next, a sheet conveying control according to an alteration of the illustrated embodiment will be explained with reference to FIGS. 10 and 11. Incidentally, since a sheet feeding portion has the same construction as that shown in FIGS. 1, 2 and 3, duplicated explanation thereof will be omitted.

Figure 10:
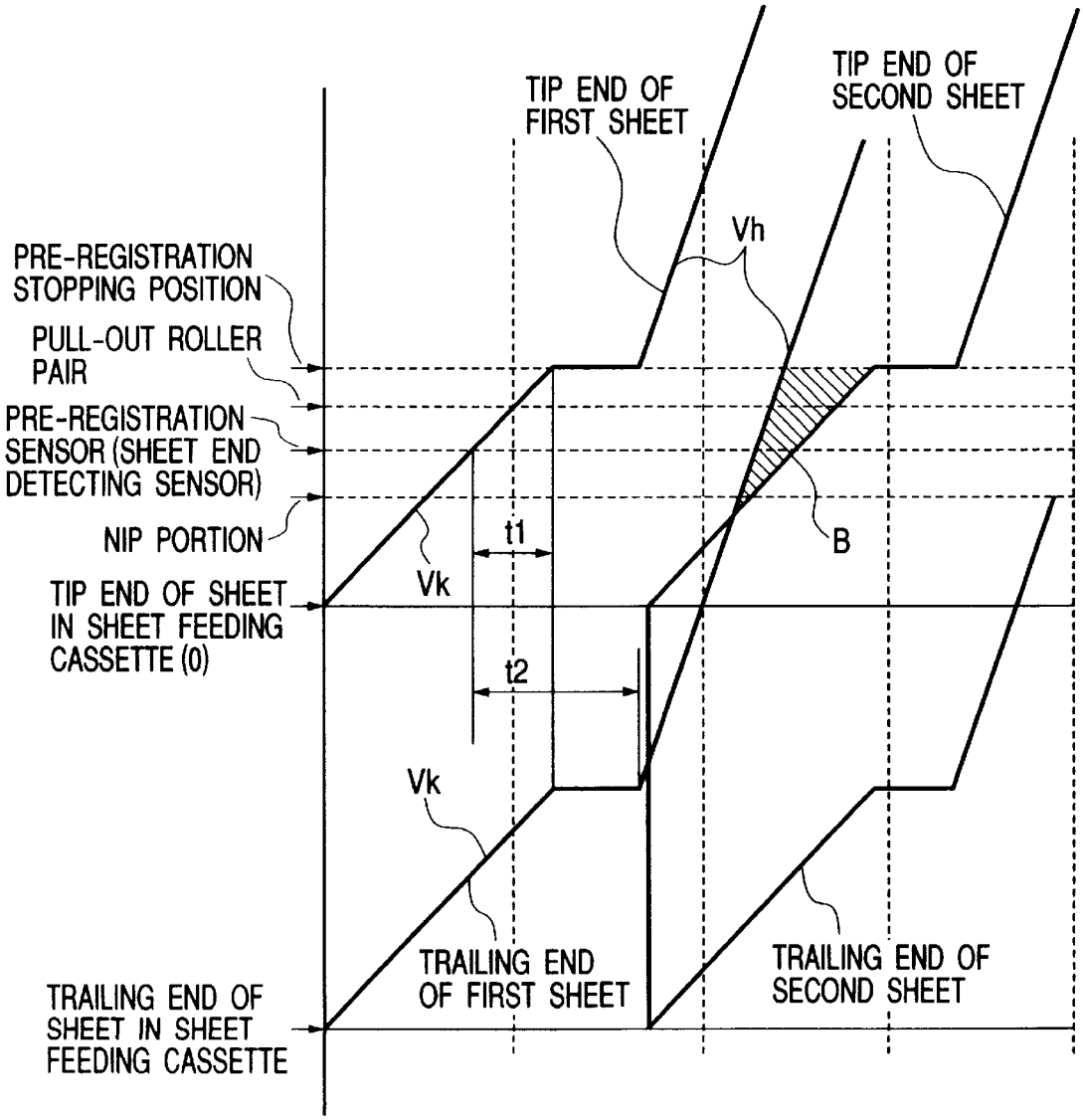
FIG. 10 is a timing chart in a uniform speed sheet feeding of a sheet feeding portion according to an alteration of the first embodiment.
Figure 11:
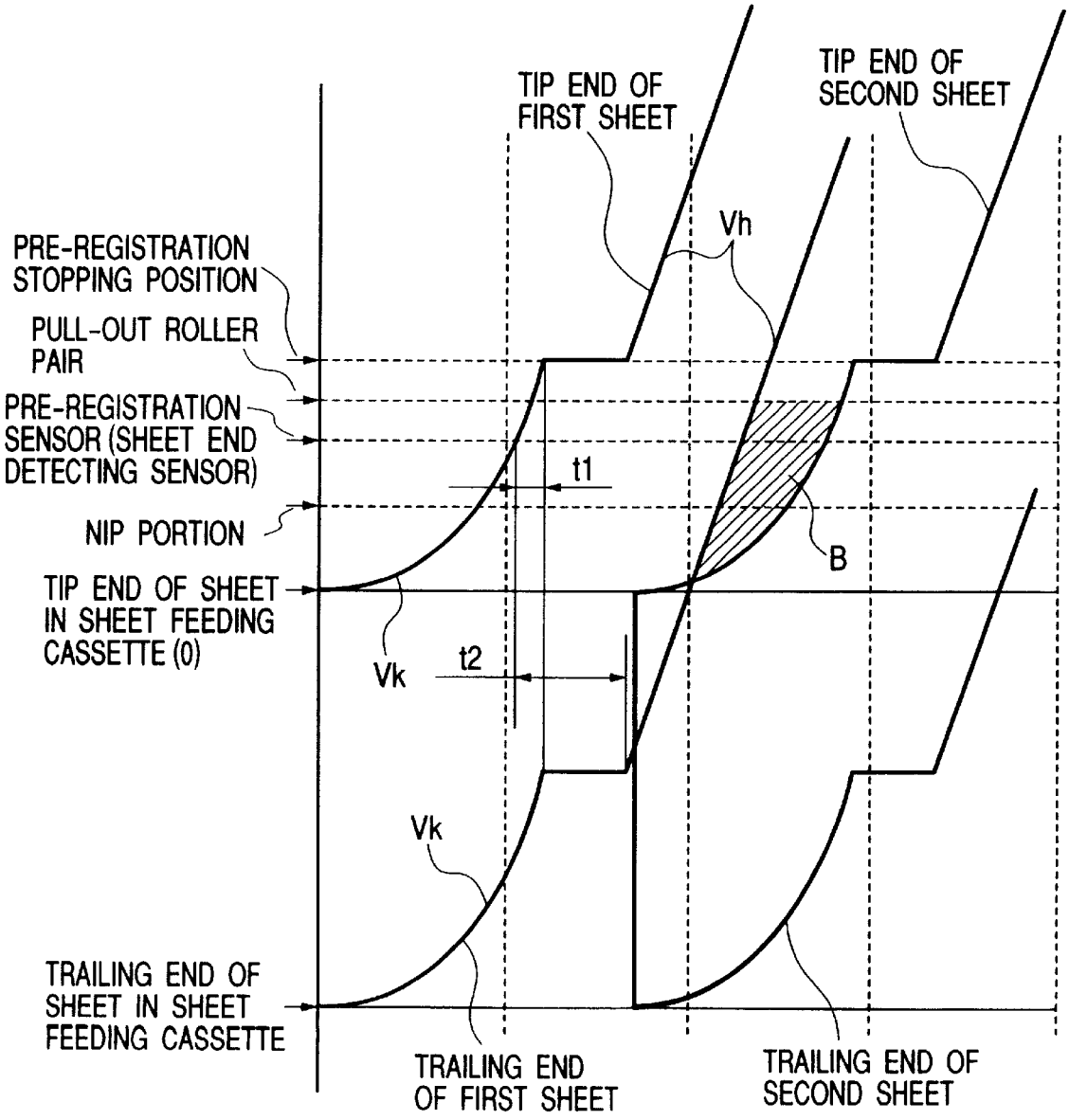
FIG. 11 is a timing chart in slow-up of the sheet feeding portion according to the alteration of the first embodiment.

FIGS. 10 and 11 are timing charts of sheet conveyance similar to those shown in FIGS. 5 and 6 and show a continuous conveying condition that two sheets are conveyed by the sheet feeding portion. In FIGS. 10 and 11, the abscissa indicates "time" and the ordinate indicates "conveying distance in the sheet path", and positions of rollers and sensors are shown with assuming a leading end of the sheet in the sheet feeding cassette 29 (a sheet leading end position in the sheet feeding start) as a zero position.

In FIG. 10, a first upper oblique line shows a state that a first sheet S is being conveyed, and a lower oblique line shows a state that a trailing end of the first sheet S is similarly conveyed from a trailing end position of the sheet in the sheet feeding cassette 29.

When the sheets S start to be conveyed, the leading ends of the sheets S firstly reach the nip portion N of the separating means and are separated one by one by means of the sheet feeding roller 5 and the retard roller 4, and the separated sheet is conveyed. Then, the leading end of the sheet is detected by the sheet end detecting sensor (pre-registration sensor) 1, control means starts count-up of a timer. When the sheet S being conveyed exceeds the pull-out roller pair 2, since the count of the timer has a value indicating a desired timing (t1 in FIG. 10), the control means emits command for pre-registration stop of the sheet S.

After the sheet is temporarily stopped at a predetermined position in this way, by re-feeding the sheet at a predetermined timing, it is possible to stabilize the leading end registration timing of the sheet S to be fed to the main body 27 of the copying machine.

Incidentally, while the sheet is stopped, the control means does not effect the count-up of the timer. The reason is that the timing for receiving re-feeding command from the control means is varied with other scanner portion and fixing portion, and an operation preparing condition of a post-processing system, and, thus, such timing is not always constant.

Then, in dependence upon a wiring preparing timing, the control means emits re-feeding command for the sheet S. In this way, the sheet S is conveyed into the main body 27 of the copying machine. Meanwhile, the value of the timer becomes a sheet feeding timing (t2 in FIG. 10) for a next sheet S in the continuous sheet feeding, and the control means commands the sheet feeding start for the next sheet S.

As shown in FIG. 10, in the illustrated embodiment, upon sheet feeding of the next sheet, since the trailing end of the preceding sheet S still remains in the sheet feeding cassette 29, in the start of the sheet feeding, the trailing end of the preceding sheet S is overlapped with the leading end of the succeeding sheet S.

Since a sheet pulling-out speed (second conveying speed) of the pull-out roller pair 2 is sufficiently greater than a feeding speed (first conveying speed) of the pick-up roller 3 and the sheet feeding roller 5 (to create speed difference therebetween), a interval (sheet interval) will be created later between the trailing end of the preceding sheet S and the leading end of the succeeding sheet S.

In this alteration, since the nip portion N between the sheet feeding roller 5 and the retard roller 4 constituting the separating means is positioned in an area (in the conveying path H1 corresponding to a hatched area B in FIG. 10) where the sheet interval is generated, even if there is no sheet interval between the preceding sheet and the succeeding sheet and these sheets are overlapped in the start of the sheet feeding, it is well possible to separate the sheets one by one positively and detect the leading end of the sheet being conveyed by means of a standard sensor.

Next, a relationship between an arrangement and sheet feeding control of the conveying system will be explained.

When it is assumed that the feeding speed is Vk, the pulling-out speed is Vh and a distance from the tip end of the sheet feeding cassette 29 to the nip portion N is L (refer to FIG. 1), the position of the sheet in the sheet feeding cassette 29 and the position of the sheet feeding roller 5 (nip portion N) are defined and the sheet conveying control is defined by the following relationship:

$$\int_{0\to t} Vh\cdot dt \geq \int_{0\to t} Vk\cdot dt = L$$

In the above relationship, "t" is a value defined by "L" and indicates a time period from when the sheet is fed out to when the sheet reaches the sheet feeding roller 5 (nip portion N).

FIG. 10 shows a case where the rotations of the sheet feeding roller 5 and the pick-up roller 3 are started by using a clutch in a transmitting path (omitted in FIG. 3) for rotational movement from the sheet feeding motor M1 and by engaging the clutch after the sheet feeding motor M1 is previously rotated, i.e., a case where the sheet feeding is started at a uniform speed (uniform speed sheet feeding).

On the other hand, in FIG. 11, since any clutch is not used in a transmitting path (omitted in FIG. 3) for rotational movement from the sheet feeding motor M1 and the sheet feeding roller and the pick-up roller are directly connected to the sheet feeding motor M1 to effect control for gradually increasing the number of revolutions of the sheet feeding motor M1, the numbers of revolutions of the sheet feeding roller 5 and the pick-up roller 3 are also gradually increased. That is to say, the sheet feeding speed is gradually increased (slow-up sheet feeding).

In this case, even in the same productivity (the same number of feeding sheets per unit time), since the speed of the sheet is reduced when the sheet enters into the nip portion N between the sheet feeding roller 5 and the retard roller 4, if conditions (retard pressure and returning force of the torque limiter) are the same, it is advantageous regarding separability. Incidentally, the effect according to the illustrated embodiment are not changed not only in the uniform sheet feeding but also in the slow-up sheet feeding.

Accordingly, in this alteration, the sheets S which were overlapped are prevented from entering into the separating means, thereby permitting further stable sheet separation.

By the way, in the above description, while an example that the sheets conveyed in the overlapped condition upon the initiation of the sheet feeding of the sheet conveying apparatus create the sheet interval in the sheet feeding portion was explained, the present invention is not limited to such an example, the sheet interval may be created in the conveying portion of the sheet conveying apparatus.

Next, a second embodiment of the present invention in which the sheet interval is created in the conveying portion of the sheet conveying apparatus will be explained.

Figure 12:
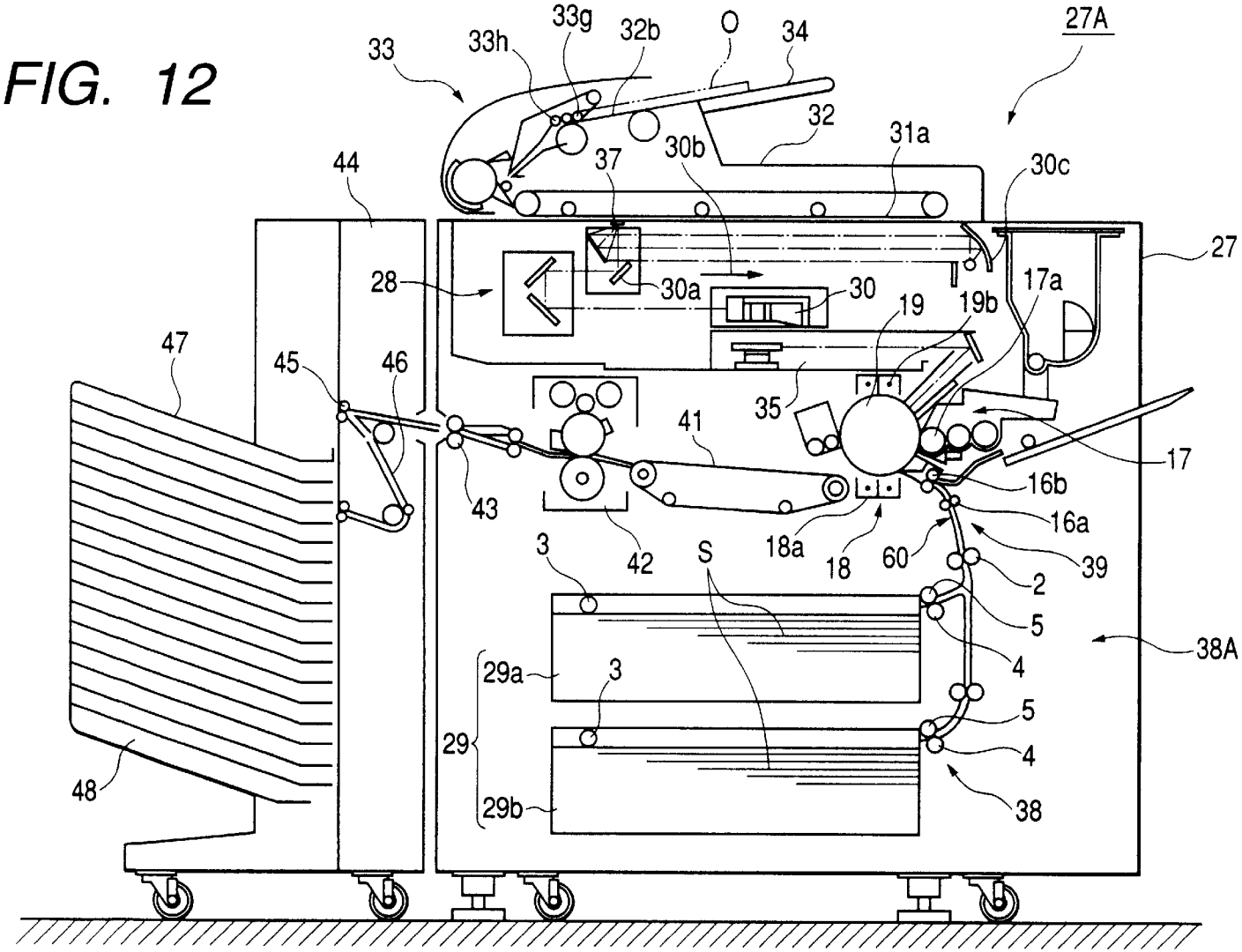
FIG. 12 is a view showing a schematic construction of an image forming apparatus having a sheet conveying apparatus according to a second embodiment of the present invention.
Figure 13:
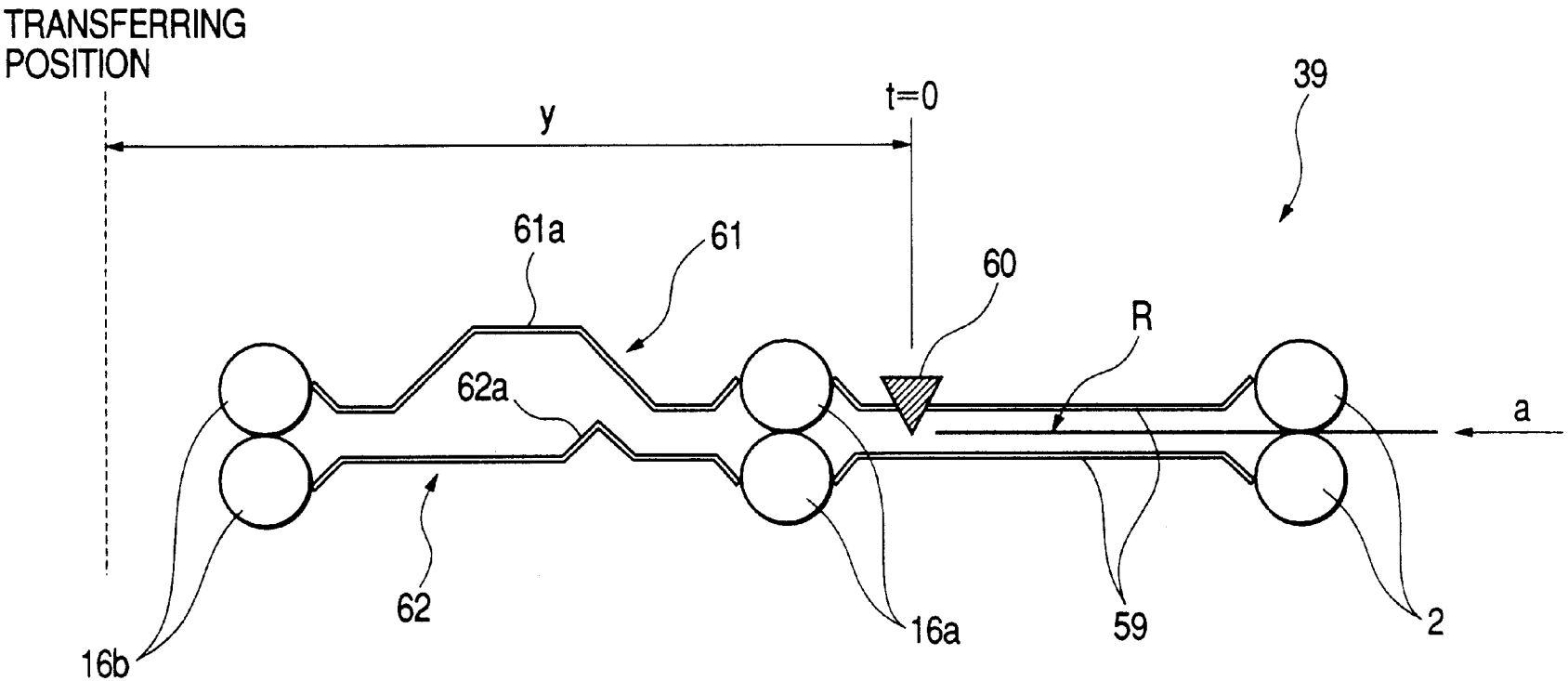
FIG. 13 is a view showing a construction of a conveying portion of the sheet conveying apparatus.

FIG. 12 is a view showing a schematic construction of an image forming apparatus having a sheet conveying apparatus according to the second embodiment, and FIG. 13 is a view showing the conveying portion of the sheet conveying apparatus. Incidentally, in FIGS. 12 and 13, elements same as or similar to those shown in FIG. 4 are designated by the same reference numerals.

In FIGS. 12 and 13, the symbol "R" denotes a sheet conveying passage, and the reference numeral 2 denotes a pull-out roller pair constituting first conveying means in this embodiment; 16*a* denotes a first conveying roller pair constituting second conveying means provided in the sheet conveying passage R; and 16*b* denotes a second conveying roller pair constituting third conveying means provided in the sheet conveying passage R.

The first and second conveying roller pairs 16*a*, 16*b* and the pull-out roller pair 2 are arranged from an upstream side with distance smaller than a length of a sheet having a minimum size to be conveyed. Incidentally, in the illustrated embodiment, since the minimum size of the sheet to be conveyed is A4 size (297 mm×210 mm), the distances between the roller pairs 2, 16*a*, 16*b* are set to about 200 mm.

In the illustrated embodiment, a detecting sensor 60 of the flag type as detecting means is constituted by a combination of an actuator of flag type and a photo-interrupter. A guide plate pair 59 is disposed between the pull-out roller pair 2 and the first conveying roller pair 16*a* and forms a part of the sheet conveying passage R. In the illustrated embodiment, a distance between the pair of guide plate 59 is set to about 2 mm to prevent delay or stability of a detecting timing due to up-and-down vibration of the sheet being conveyed, i.e., to enhance detecting sensitivity of the detecting sensor 60.

On the other hand, upper and lower guide plates 61, 62 as guide member pair are disposed between the first and second conveying roller pairs 16*a* and 16*b* and form a part of the sheet conveying passage R. The upper guide plate 61 is provided with a curved portion 61*a* by which a loop is formed in the sheet being conveyed when the first conveying roller pair 16*a* is rotated at a sheet conveying speed faster than those of the pull-out roller pair 2 and the second conveying roller pair 16*b*, as will be described later.

Further, the lower guide plate 62 is provided with a protruded portion 62*a* by which the sheet is looped toward the curved portion 61*a*. The protruded portion 62*a* is protruded above the nip portion of the first conveying roller pair 16*a*, so that a loop forming direction can be directed toward the curved portion 61*a*, with the result that sheet can be conveyed stably while forming the loop.

Incidentally, as will be described later, the protruded portion 62*a* also serves to prevent the striking between the preceding sheet and the succeeding sheet when the preceding sheet after formation of the loop and the succeeding sheet conveyed thereafter are moved to reduce the interval (sheet interval) again or are overlapped, thereby determining an overlapping direction.

Next, a sheet separating and conveying operation of the sheet conveying apparatus 38A for feeding out the sheets in a partially overlapped condition will be explained.

Figure 14:
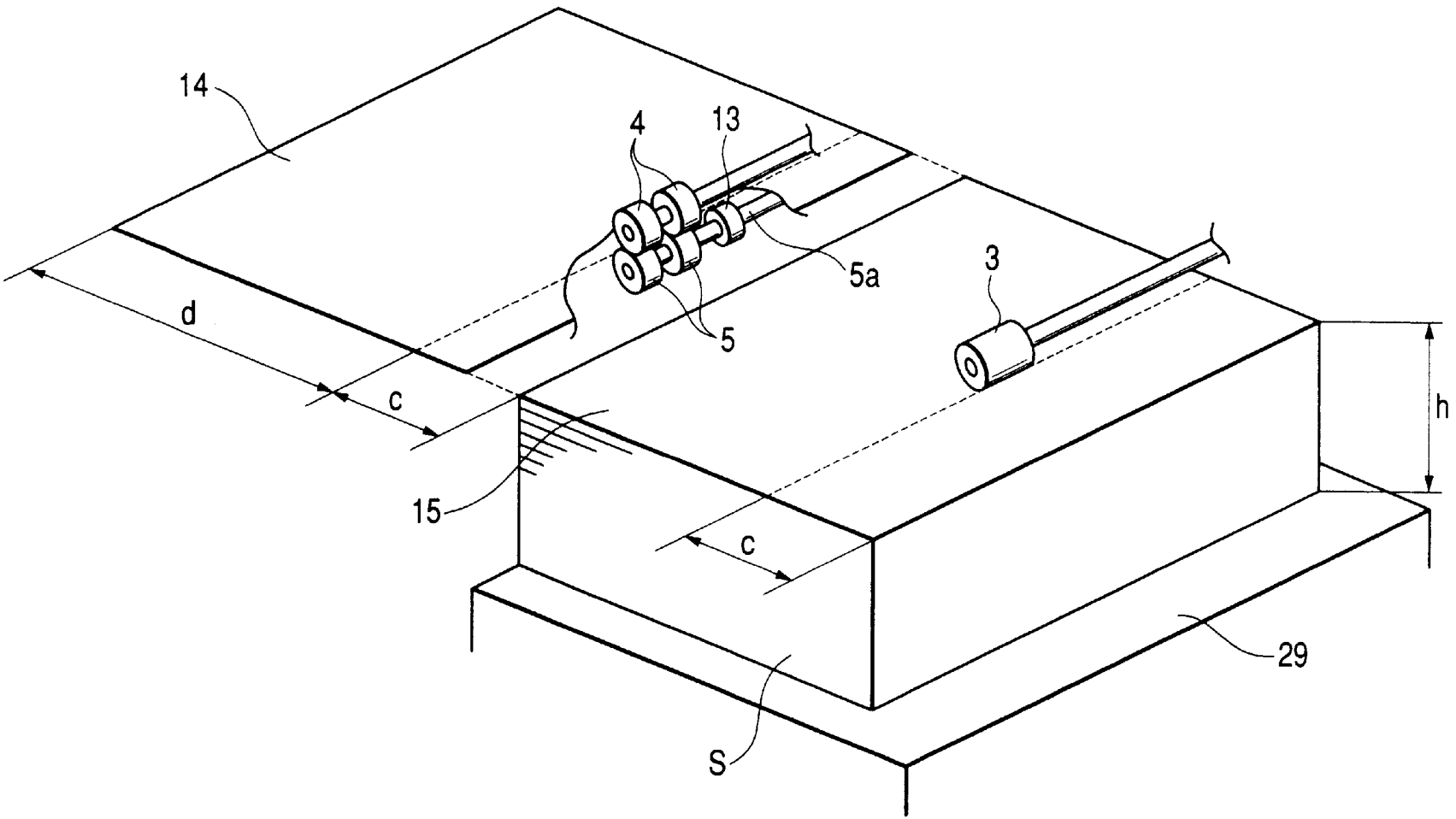
FIG. 14 is a perspective view for explaining a main construction of a sheet feeding portion of the sheet conveying apparatus.

In the illustrated embodiment, as shown in FIG. 14, by the action of the pick-up roller 3, a sheet (referred to as "succeeding sheet" hereinafter) nest to the sheet 14 being precedingly conveyed (referred to as "preceding sheet" hereinafter) is always conveyed near the nip between the sheet feeding roller 4 and the retard roller 5 (by a distance c). Incidentally, to enable such arrangement, in the illustrated embodiment, the pick-up roller 3 is disposed at a position as shown in FIG. 14.

The distance c indicates a distance from a leading end of the sheet S contained in the sheet feeding cassette 29 (29*a*, 29*b*) to the nip (referred to as "separation nip portion" hereinafter) between the sheet feeding roller 4 and the retard roller 5, and the pick-up roller 3 is disposed in front of and spaced apart from a trailing end of the sheet by the distance c and is fixed at a sheet feeding height h. Further, the pick-up roller 3 is always rotatably supported at the position of the sheet feeding height h during the continuous sheet feeding and is always rotated during the sheet feeding operation to always feed the uppermost sheet up to the vicinity of the separation nip portion.

Incidentally, even if the plural sheets are conveyed up to the vicinity of the sheet feeding roller, behind of the sheet feeding roller 4, by the action of the retard roller 5, the sheets are separated and conveyed one by one. Further, when the sheet has already been conveyed to the vicinity of the separation nip portion, since the underlying sheets which are not yet conveyed are not contacted with the pick-up roller 3, they are not conveyed.

Figure 15:
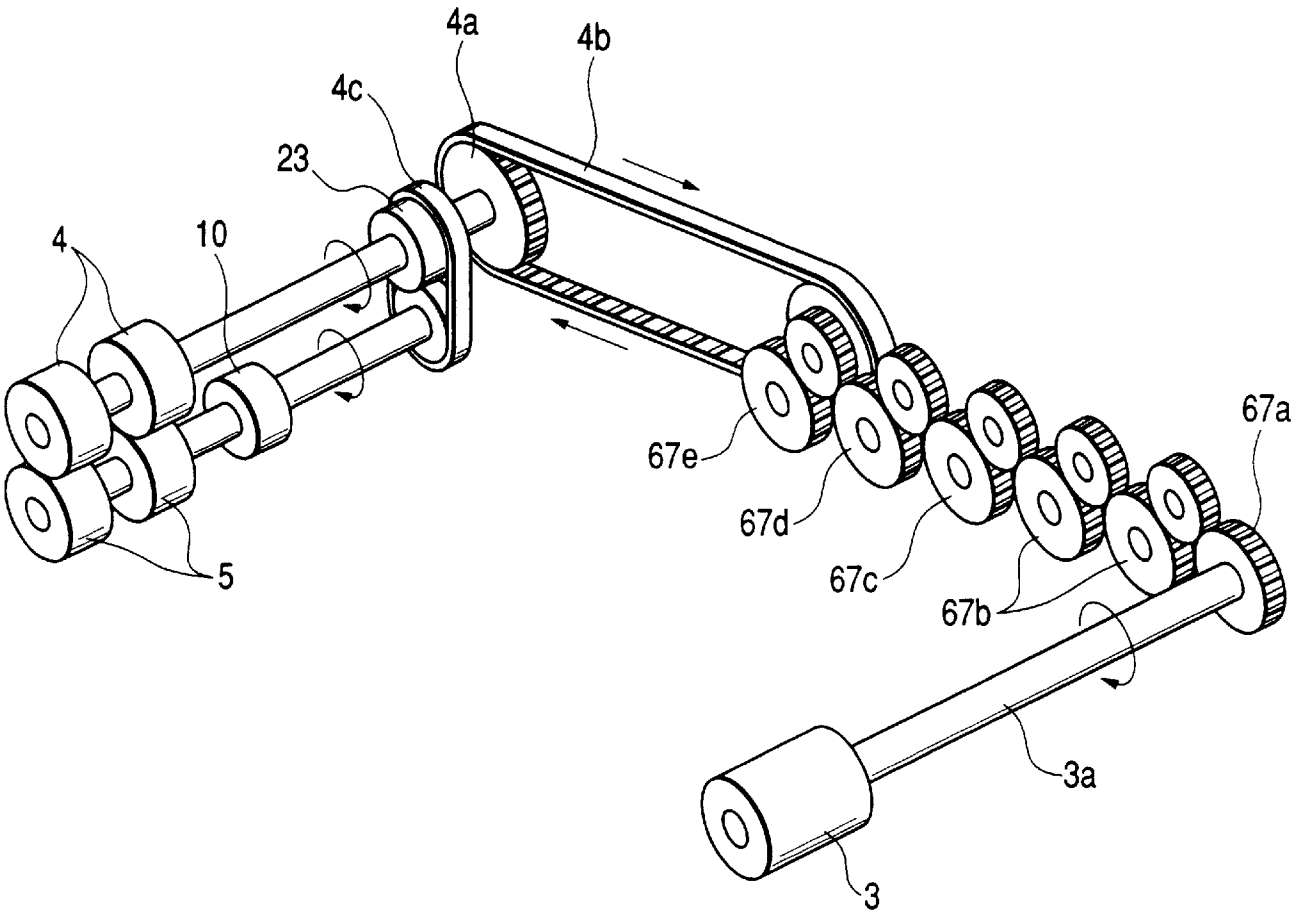
FIG. 15 is a perspective view for explaining a driving mechanism for a pick-up roller provided in the sheet feeding portion.

As shown in FIG. 15, in the pick-up roller 3, a shaft 3*a* is selectively attached to one (for example, drive gear 67*a*) of plural drive gears 67*a* to 67*e* in accordance with the sheet size, so that the pick-up roller 3 can be positioned ahead of the trailing end of the sheet by the distance c regardless of the sheet size.

Incidentally, in FIG. 15, rotation of a drive pulley 4*a* for driving the pick-up roller 3, sheet feeding roller 4 and retard roller 5 is transmitted to the pick-up roller 3 and the retard roller 5 through the sheet feeding roller 4 and drive input belts 4*b*, 4*c*. Incidentally, if the succeeding sheet 15 is conveyed up to the vicinity of the nip between the sheet feeding roller 4 and the retard roller 5, other arrangements may be used.

By the way, while the preceding sheet 14 is being conveyed by a given amount d sown in FIG. 14, a driving force for effecting rotation opposite to the conveying direction is inputted to a rotary shaft 5*a* of the retard roller through the drive input belt 4*c* and an electromagnetic clutch 23 shown in FIG. 15, with the result that other sheets than the preceding sheet (to be conveyed) being conveyed up to the vicinity of the separation nip portion are returned by the action of the torque limiter 10.

On the other hand, after the preceding sheet 14 was conveyed by the given amount d, the electromagnetic clutch 23 is turned OFF, with the result that the retard roller 5 is rotatingly driven by the rotation of the sheet feeding roller 4. With this arrangement, the preceding sheet 14 and the succeeding sheet 15 are fed with the desired overlapping amount and are transferred to the conveying portion 39.

In this case, the overlapping amount K is given by [L (length of the sheet in the conveying direction)−d]. If d is a length in the conveying direction, the overlapping amount K becomes zero, and, thus, the sheet are conveyed with zero sheet interval. Incidentally, if the sheet interval is zero in this way, the electromagnetic clutch 23 can be omitted and the sheet feeding roller 4 is always rotated.

Figure 16:
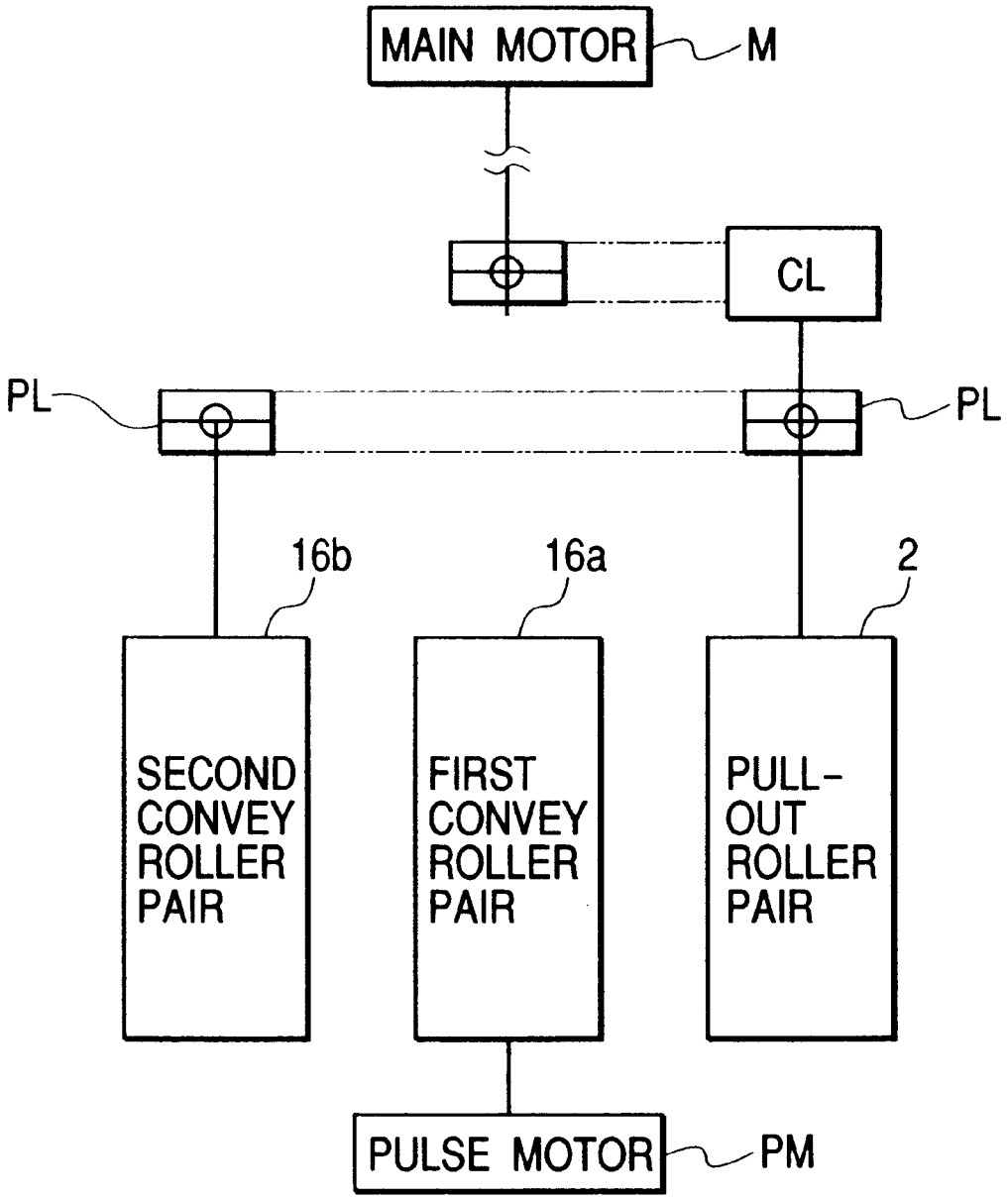
FIG. 16 is a block diagram of a driving system of the sheet conveying apparatus.

Further, FIG. 16 is a block diagram of the driving system of the sheet conveying apparatus. As shown in FIG. 16, during the continuous conveying operation, the pull-out roller pair 2 and the second conveying roller pair 16*b* are always rotated at a first conveying speed v by a driving force of a main motor M transmitted by a clutch CL and a pulley PL.

Further, the first conveying roller pair 16*a* is driven by a single pulse motor PM and a rotational speed (sheet conveying speed) thereof is variable. Incidentally, in the illustrated embodiment, the first conveying roller pair 16*a* can convey the sheet at the first conveying speed v and at a second conveying speed V faster than the first conveying speed.

Figure 17:
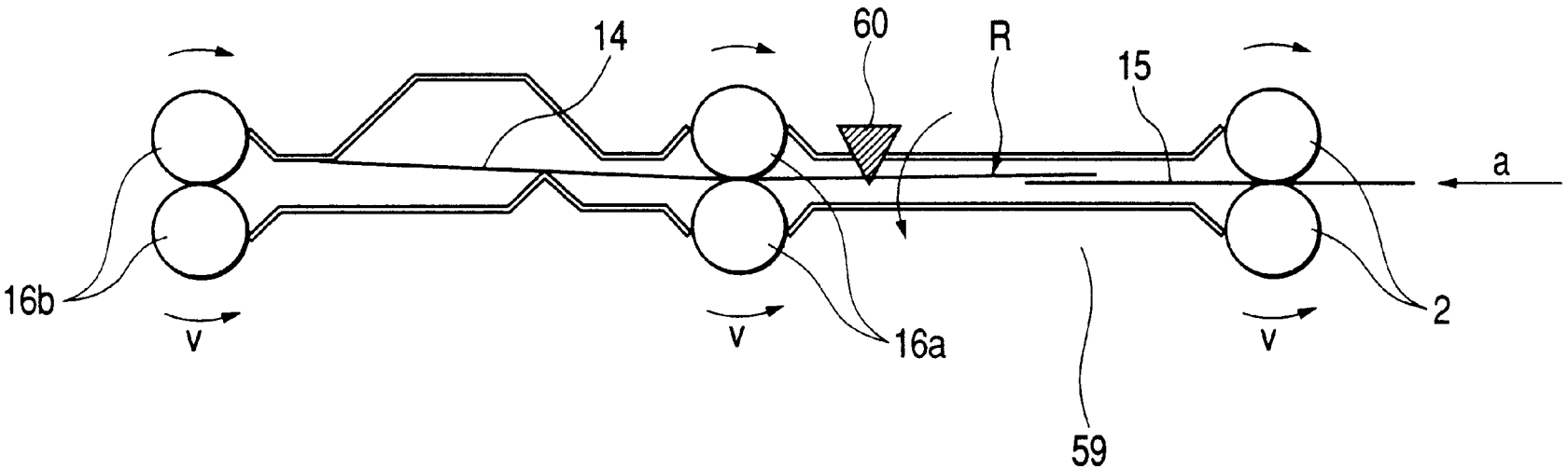
FIG. 17 is a first view for explaining a sheet continuous conveying operation of the sheet conveying apparatus.

Next, a sheet continuous conveying operation of the sheet conveying apparatus having the above-mentioned construction will be explained. As mentioned above, the preceding sheet 14 and the succeeding sheet 15 transferred to the conveying portion 39 are conveyed as shown in FIG. 17. Incidentally, in the illustrated embodiment, when the sheets are conveyed continuously, the interval (sheet interval) between the preceding sheet 14 and the succeeding sheet 15 is set to slightly minus so that two sheets 14, 15 are conveyed in a direction shown by the arrow a in FIG. 17 with partial overlap therebetween.

Figure 18:
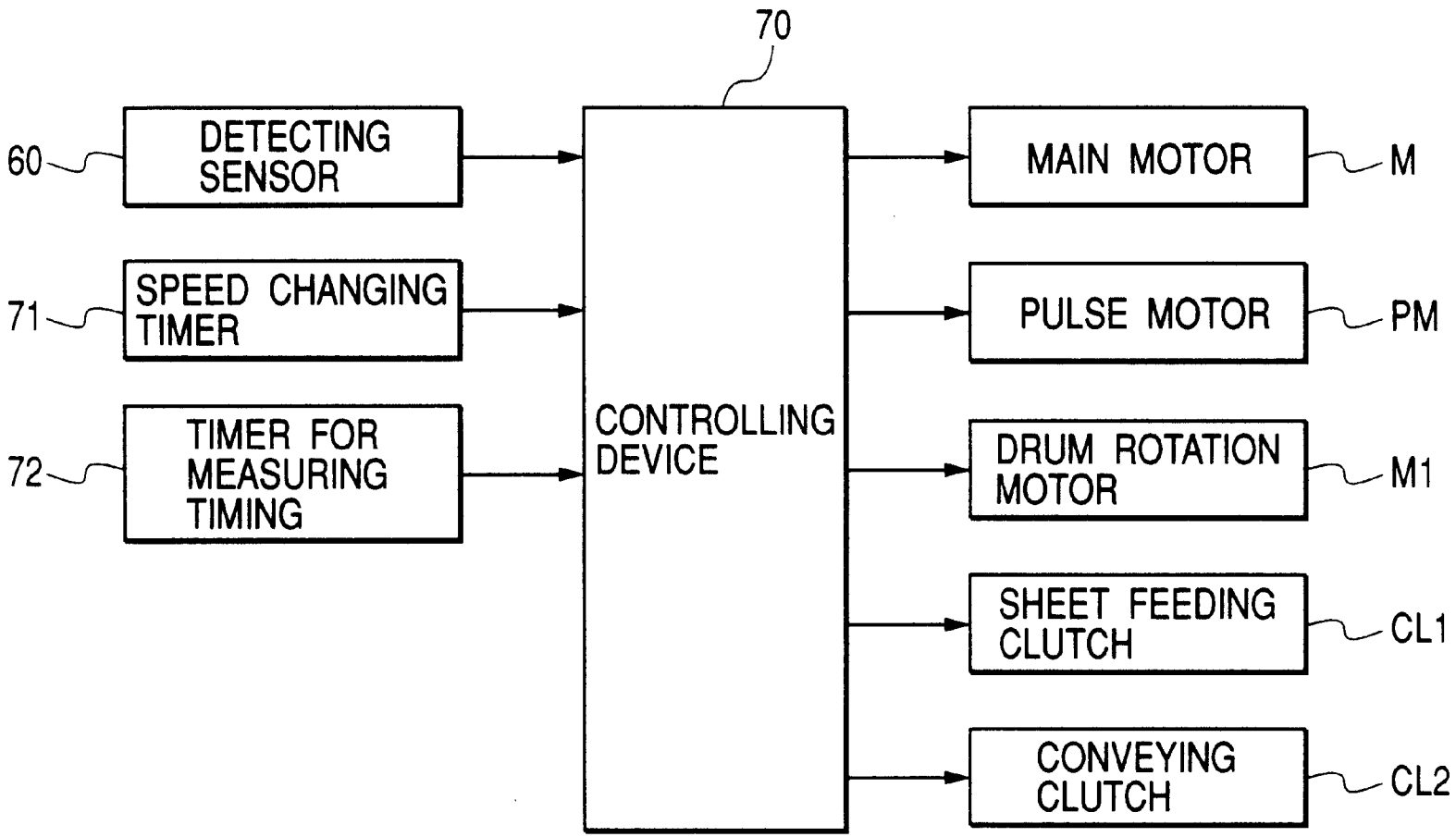
FIG. 18 is a control block diagram of the sheet conveying apparatus.

The sheets 14, 15 being conveyed are firstly conveyed at the first conveying speed v by means of the pull-out roller pair 2. Thereafter, when the leading end of the preceding sheet 14 is detected by the detecting sensor 60, a control device 70 as control means shown in FIG. 18 starts the count of a speed changing timer 71 on the basis of a detection signal from the detecting sensor 60 and changes the sheet feeding speed of the first conveying roller pair 16*a* from the first conveying speed v to the second conveying speed V on the basis of count information from the speed changing timer 71. As a result, plus sheet interval can be created between the preceding sheet 14 and the succeeding sheet 15 being conveyed with minus sheet interval (i.e., with predetermined overlap).

When it is assumed that a timing for changing the sheet conveying speed (time period from when the sheet is detected by the detecting sensor 60 to when the sheet conveying speed is changed) is θ, a minimum plus sheet interval by which the detecting sensor 60 can detect the sheets being continuously conveyed is w and the sheet size is L, in order to create the minimum plus sheet interval w when the sheets 14, 15 are continuously conveyed, the following relationship must be established. Incidentally, θ is a value determined the size of the sheet conveyed:

$$(L-v\theta+w)/V<(L-v\theta-K)/v \quad (1)$$

Further, by forming the minimum plus sheet interval w in this way, although the detecting sensor 60 can detect the leading end of the sheet, since the minimum sheet distance w is formed between the first and second roller pairs, as shown in FIG. 17, the detecting sensor 60 is positioned at an area for forming the minimum sheet interval w between the first and second roller pairs. In other words, the minimum plus sheet interval w is created at the position of the detecting sensor 60.

Next, the installation position of the detecting sensor 60 will be fully described.

First of all, since the pull-out roller pair 2 had to already convey the preceding sheet 14 when the sheet conveying speed of the first conveying roller pair 16*a* is changed from the first conveying speed v to the second conveying speed V, the position F of the detecting sensor 60 (distance from the pull-out roller pair 2) must satisfy the following relationship:

$$[F>L-v\theta]$$

Incidentally, in case of the sheet conveying apparatus in which the sheets having plural sizes are conveyed as is in the illustrated embodiment, it is preferable that the value F is set to be greater in accordance with the long size sheet; namely, the position of the detecting sensor 60 is set in the vicinity of the first conveying roller pair 16*a*.

If the position of the detecting sensor 60 is set in the vicinity of the first pull-out roller pair 2, control may be effected in such a manner that the conveying speed of the first conveying roller pair 16*a* is returned to the first conveying speed v at a time when the leading end of the succeeding sheet 15 is detected by the detecting sensor 60 so that the deflection (loop) in the sheet (described later) generated by the speed difference, for example, between the first and second conveying roller pairs 16*a* and 16*b* does not become so great.

However, if such control is effected, it is considered that sheet conveying position control become unstable; for example, when the final sheet is conveyed, the loop may become so great, or, in case of the short size sheet, although the loop is not generated between the second and third conveying roller pairs 2 and 3, in case of the long size sheet, the loop is generated. Accordingly, it is preferable that the detection sensor 60 be installed in the vicinity of the first conveying roller pair 16*a*.

Further, in the illustrated embodiment, the positional relationship of the detecting sensor 60 is determined so that the leading end of the sheet to be looped has already reached the nip portion of the second conveying roller pair 16*b* upon timing for changing the conveying speed of the first conveying roller pair 16*a* in order that the amount of the generated loop always becomes the same even when any size sheet is conveyed and regardless of the presence/absence of the succeeding sheet and the generated loop does not becomes excessively great. More specifically, the value F is set to 180 mm (20 mm up to the first conveying roller pair 16*a* when the distance between the pull-out roller pair 2 and the first conveying roller pair 16*a* is set to 200 mm), thereby establishing the good detecting sensitivity and stable conveying control.

By arranging the detecting sensor 60 in such a position, the loop can stably be generated in the sheet between the first and second conveying roller pairs 16*a* and 16*b*. Incidentally, when it is assumed that the distance from the detecting sensor 60 to the first conveying roller pair 16*a* is f (20 mm in the illustrated embodiment), the distance between the pull-out roller pair 2 and the first conveying roller pair 16*a* is L1 and the distance between the first and second conveying roller pairs 16*a* and 16*b* is L2, the so-called loop amount 6 or flexed amount of the sheet is defined by the following equations:

$$\delta=(L-v\theta+f)/V\times(V-v),\ ((L2+f)<v\theta) \quad (2)$$

$$\delta=(L-L2)/V\times(V-v)((L2+f)\geqq v\theta) \quad (3)$$

Figure 19:
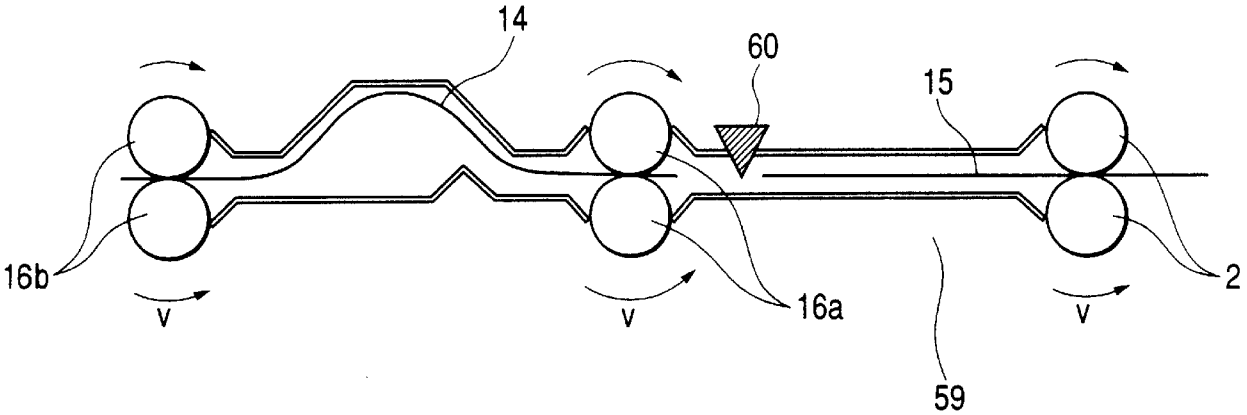
FIG. 19 is a second view for explaining a sheet continuous conveying operation of the sheet conveying apparatus.

In this way, by arranging the detecting sensor 60 in the area where the sheet interval is created between the sheets being conveyed due to the speed difference between the pull-out roller pair 2 and the first conveying roller pair 16*a*, i.e., by creating the sheet interval at the position of the detecting sensor 60, since the detecting sensor 60 is temporarily turned OFF after the trailing end of the preceding sheet 14 leaves the detecting sensor 60 and before the leading end of the succeeding sheet 15 reaches the sensor, as shown in FIG. 19, the leading end of the succeeding sheet 15 can be detected.

Figure 33:
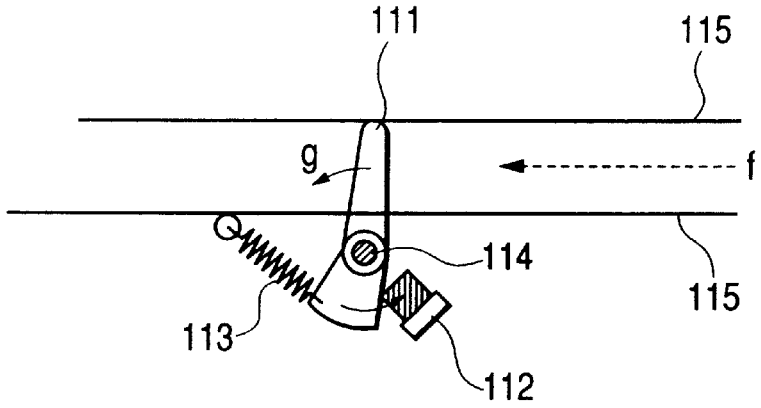
FIG. 33 is a view for explaining an arrangement of a sensor of flag type in the conventional sheet conveying apparatus.
Figure 34:
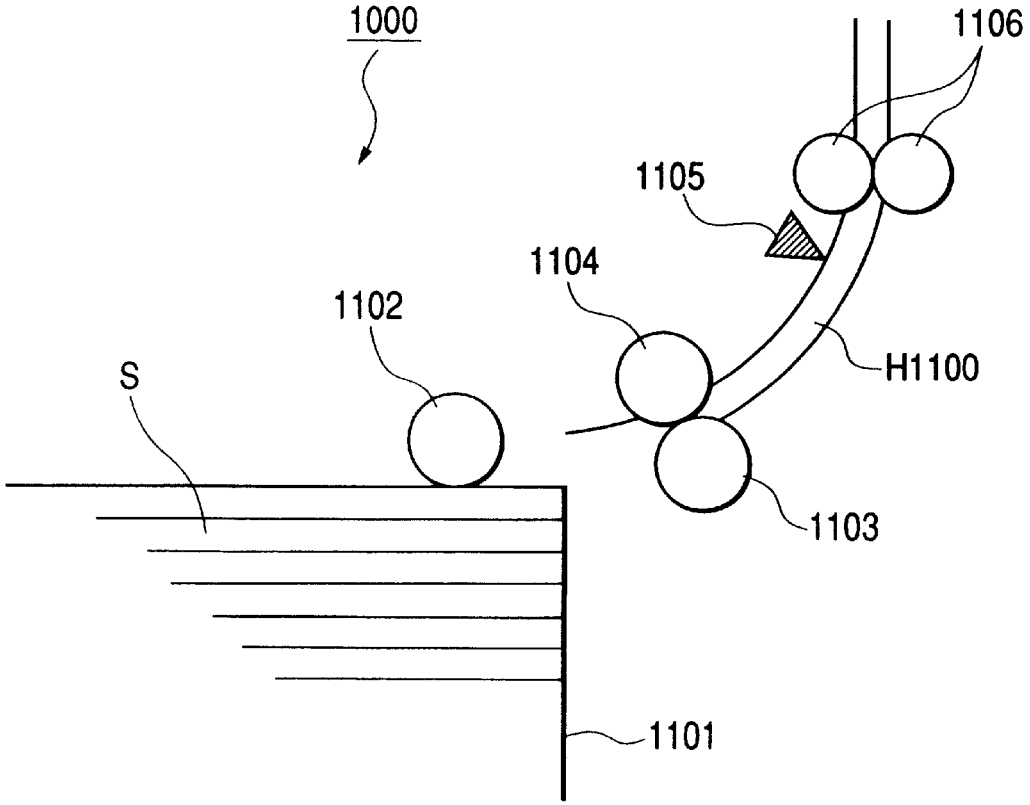
FIG. 34 is a view showing a construction of a sheet feeding portion of the conventional sheet conveying apparatus.

That is to say, when the trailing end of the preceding sheet 14 leaves the detecting sensor 60, since the succeeding sheet 15 does not yet reach the detecting sensor 60, the detecting sensor 60 is not interrupted, thereby detecting the sheet. Incidentally, since the construction and function of the detecting sensor 60 as the sensor of flag type are the same as those shown in FIG. 33, explanation thereof will be omitted here.

On the other hand, the detecting sensor which has ability for detecting the succeeding sheet 15 in this way then catches the leading end of the succeeding sheet 15, with the result that the succeeding sheet 15 is conveyed continuously under the same control as the preceding sheet 14.

By the way, when the preceding sheet 14 is conveyed by the first conveying roller pair 16*a* at the first conveying speed v and the leading end of the sheet is passed through the protruded portion 62*a* of the lower guide 62, the sheet is pushed up by the protruded portion 62*a*, with the result that the leading end of the sheet 14 is displaced upwardly.

Further, thereafter, when the sheet is conveyed at the first conveying speed v, the leading end of the preceding sheet 14 is directed into the nip portion of the second conveying roller pair 16*b*. Then, when the sheet conveying speed of the first conveying roller pair 16*a* is changed to the second conveying speed V at the speed changing timing θ described above, due to the speed difference between the first and second conveying roller pairs 16*a* and 16*b*, the loop is formed toward the curved portion 61*a*. Incidentally, the previously upwardly displaced sheet 14 is always looped upwardly due to this speed change.

Further, after the loop is formed in this way, when the trailing end of the preceding sheet 14 leaves the first conveying roller pair 16*a*, the preceding sheet 14 is conveyed by the second conveying roller pair 16*b* at the first conveying speed v.

On the other hand, when the succeeding sheet 15 reaches the first conveying roller pair 16*a* with the sheet interval created, the sheet is conveyed by the first conveying roller pair 16*a* the conveying speed of which was changed to the second conveying speed V at the speed changing timing θ. As a result that, as shown in FIG. 20, the succeeding sheet 15 catches up with the trailing end of the preceding sheet the loop of which was released, with the result that the distance between the sheets spread to achieve the plus sheet interval can be returned to the original minus condition.

Figure 20:
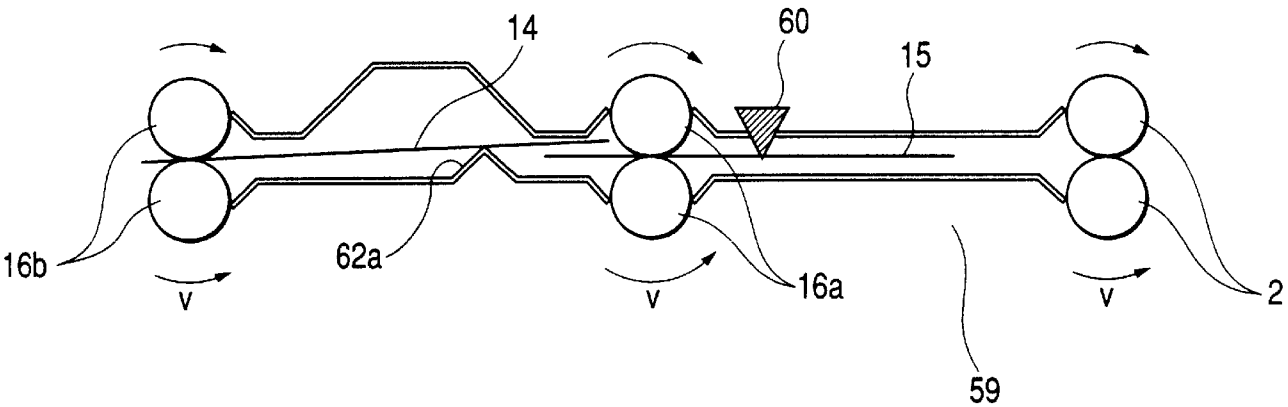
FIG. 20 is a third view for explaining a sheet continuous conveying operation of the sheet conveying apparatus.

Incidentally, in this case, as shown in FIG. 20, since the trailing end of the preceding sheet 14 is supported by the protruded portion 62*a* protruded above the nip portion of the first conveying roller pair 16*a*, the succeeding sheet 15 always enters below the trailing end of the preceding sheet 14. As a result, the stable small sheet interval control can be achieved without distorting the conveying condition of the preceding sheet 14.

Figure 21:
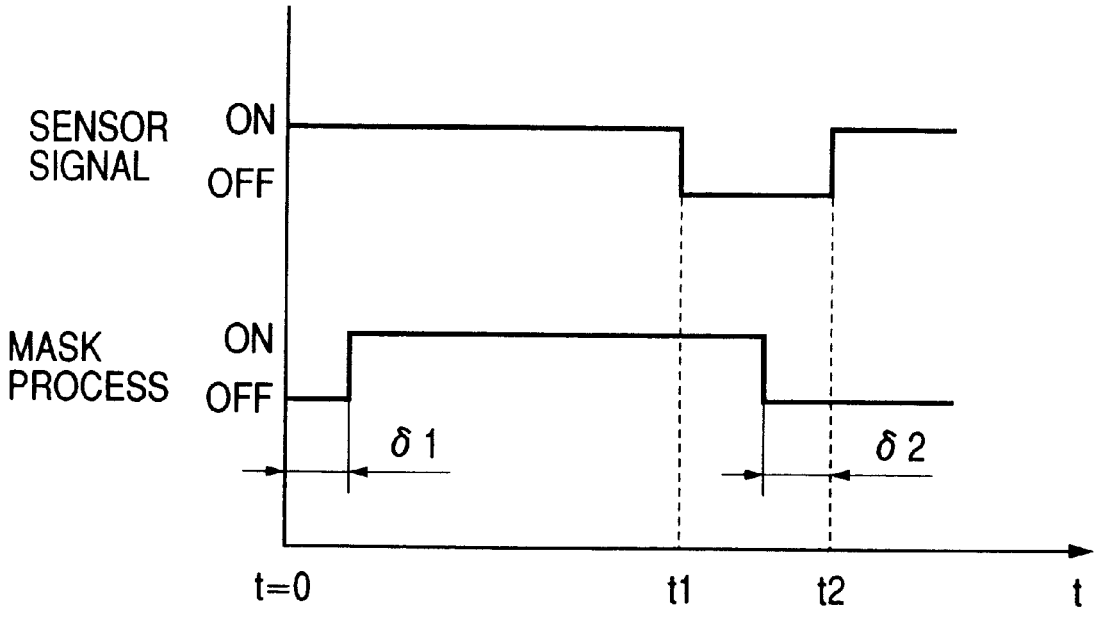
FIG. 21 is a timing chart for explaining sensor mask process of the sheet conveying apparatus.

By the way, in the illustrated embodiment, mask process for obtaining a stable sensor signal of the detecting sensor 60 is performed. FIG. 21 is a timing chart showing such mask process. The detecting timing of the detecting sensor, i.e., a time when the sensor is turned ON due to the detection of the leading end of the sheet is assumed to 0 (zero) on the time axis. When it is assumed that a time when the trailing end of the sheet is detected by the detecting sensor 60 (i.e., when the sensor is turned OFF) is t1 and a time when the detecting sensor is turned ON again by the leading end of the succeeding sheet is t2, the times t1, t2 as time timings are represented by the following equations:

$$t1=\theta+(L-v\theta)/V \quad (4)$$

$$t2=(L-K)/v \quad (5)$$

Due to mask times δ1, δ2 determined in consideration of the electrical property of the photo-sensor used and a signal stabilizing time of the sensor flag, the mask process is started after δ1 from when ON of the sensor signal is determined, and the mask process is released after (t2−δ2) from when ON of the sensor signal is determined. As a result, a more stable sensor signal can be obtained.

Incidentally, the preceding sheet the loop of which was released is ultimately conveyed to the image transferring portion 18 by the second conveying roller pair 16*b*, and the succeeding sheet 15 is similarly conveyed, thereby achieving the continuous conveyance.

Even when the preceding sheet 14 and the succeeding sheet 15 are overlapped with each other in this way or even when the sheet interval is zero, by spreading the sheet interval between the preceding sheet 14 and the succeeding sheet 15 and by arranging the detecting sensor 60 in the area where the sheet interval is spread, even if the detecting sensor 60 is constituted by an inexpensive sensor of flag type, the sheet conveying condition can be monitored. Further, by using the sensor of flag type in this way, a sheet conveying condition of a sheet of permeable type such as an OHP sheet can also be monitored.

By the way, in the illustrated embodiment, as mentioned above, the image forming timing is determined on the basis of the detection signal from the detecting sensor 60, thereby performing the image forming, image transferring, image fixing and sheet discharging operations.

Next, image forming control and sheet conveying control of the image forming apparatus having the sheet conveying apparatus according to the illustrated embodiment will be explained with reference to FIGS. 22 to 24. Incidentally, FIG. 22 is a flow chart for explaining the sheet conveying operation, FIG. 23 is a drive control block diagram, and FIG. 24 is a timing chart thereof.

Figure 22:
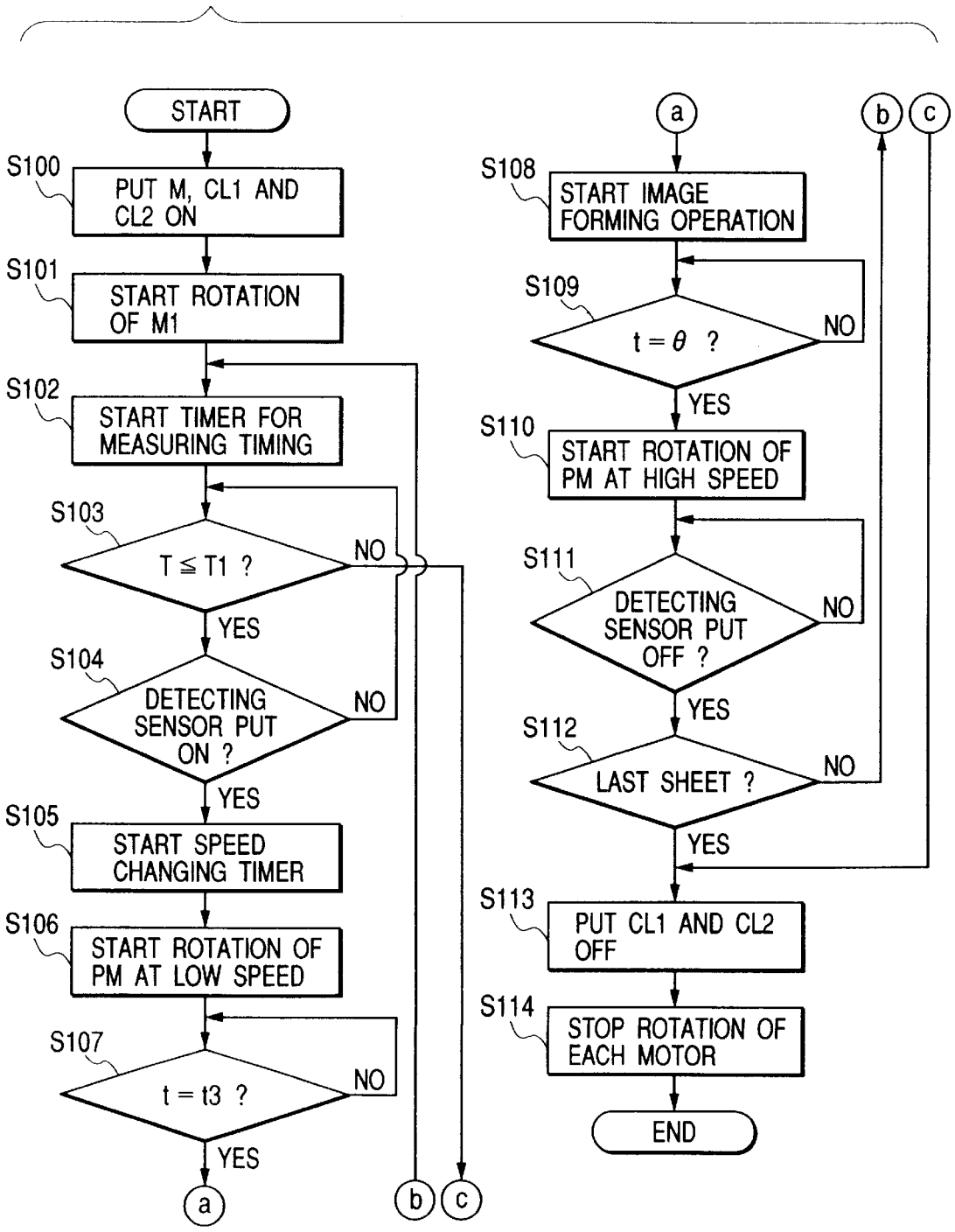
FIG. 22 is a flow chart for explaining an operation of the sheet conveying apparatus.
Figure 23:
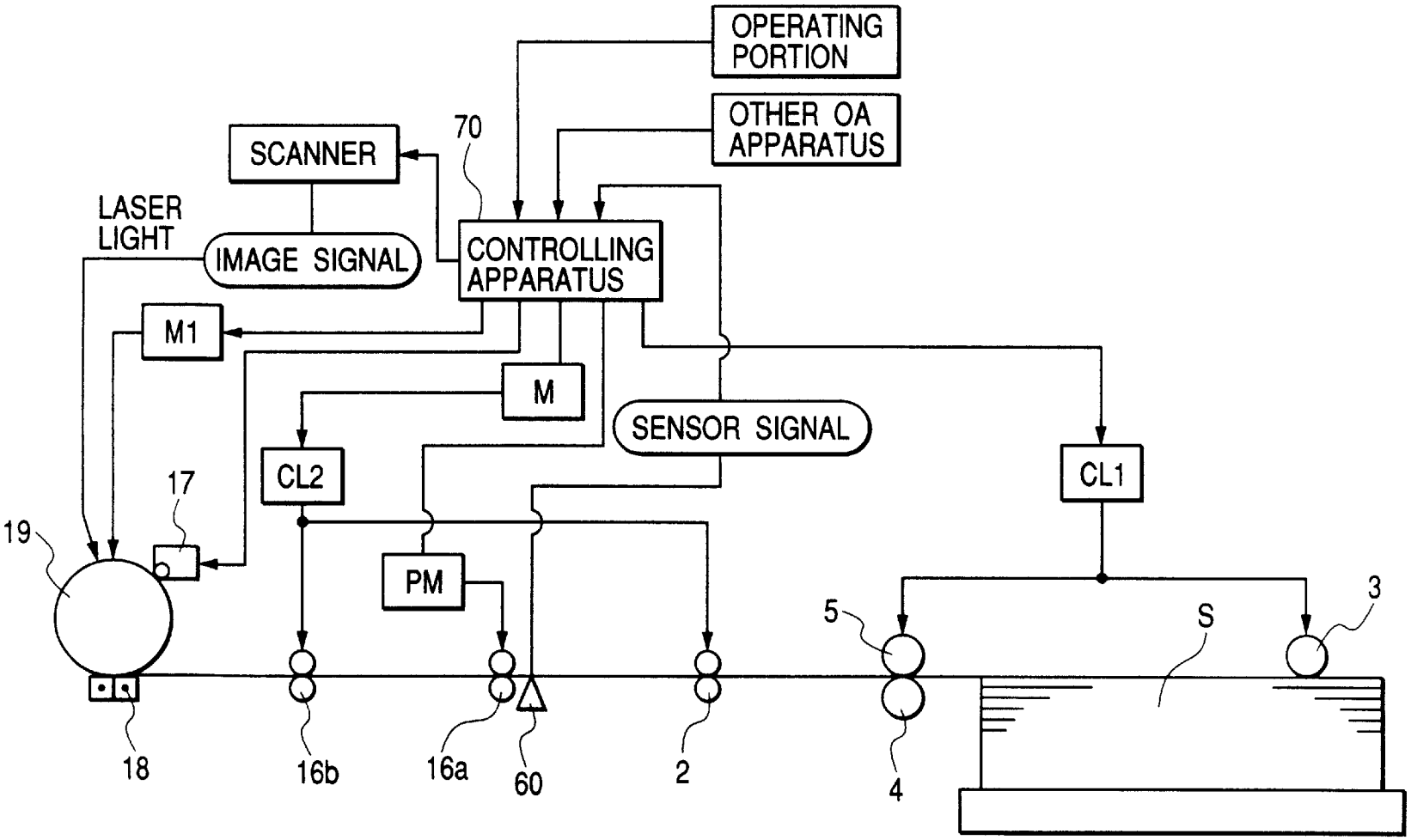
FIG. 23 is a block diagram for explaining the operation of the sheet conveying apparatus.
Figure 24:
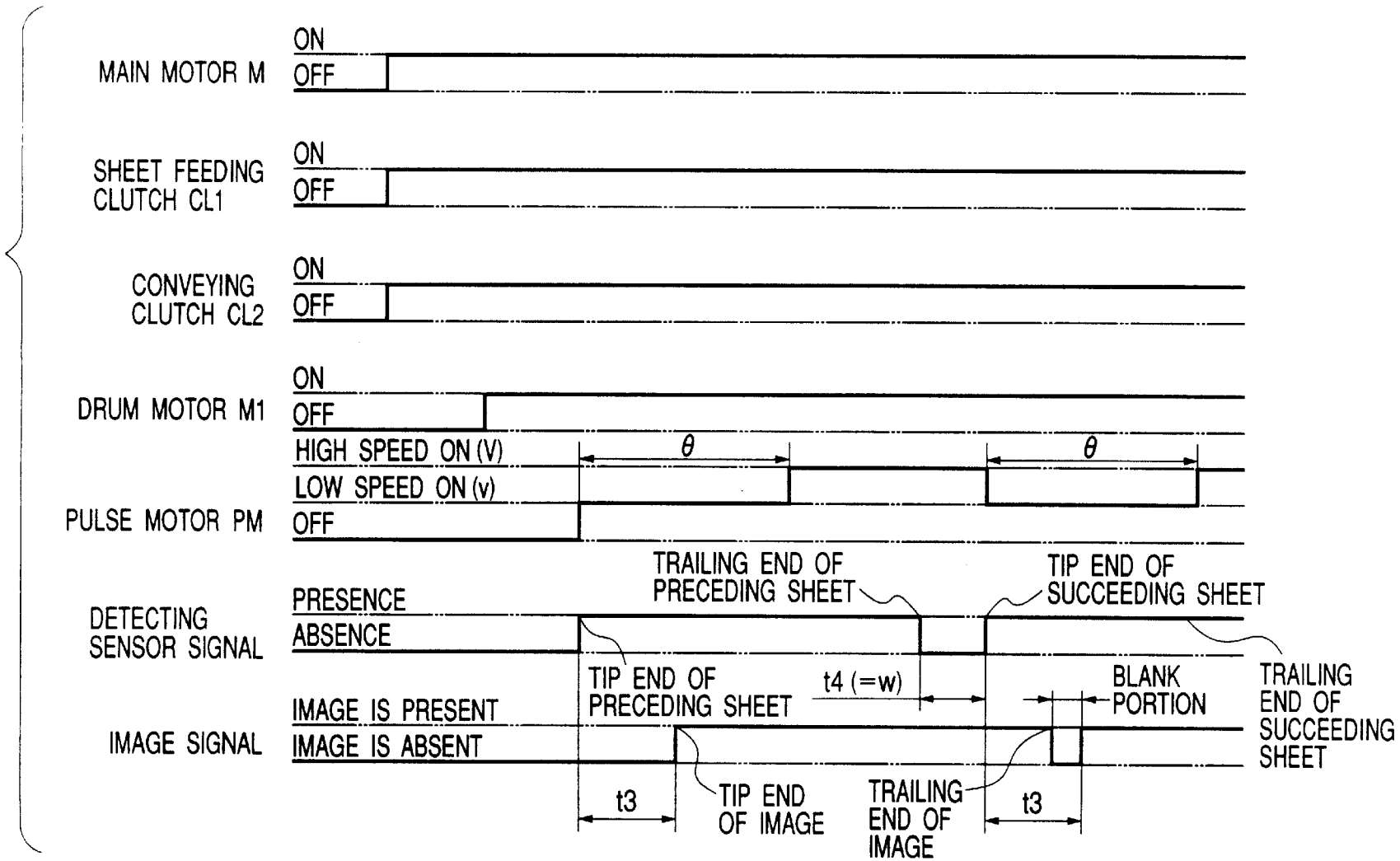
FIG. 24 is a timing chart for explaining the operation of the sheet conveying apparatus.

When output command is received from an operating portion or other OA apparatus shown in FIG. 23, as shown in FIG. 22, a control device or controller 70 rotates the main motor M and turns the sheet feeding clutch CL1 and conveying clutch CL2 ON (step S100). As a result, as shown in FIG. 23, the pick-up roller 3, sheet feeding roller 4 and retard roller 5 are subjected to the rotational driving force, with the result that the pick-up roller 3 and the sheet feeding roller 4 are rotated in the feeding direction, and the retard roller 5 to which reverse rotation is inputted is rotated in the feeding direction by the friction force between the retard roller and the sheet feeding roller 4 in opposition to the torque limiter (see FIG. 15).

By this operation, the sheets S fed out by the pick-up roller 3 are separated one by one by means of the sheet roller 4 and the retard roller 5, and the separated sheet is transferred to the conveying portion 39. Meanwhile, the control device 70 starts the rotation of a drum rotating motor M1 (step S101) and starts a timing measuring time 72 (FIG. 18) (step S102).

In the conveying portion 39, when the conveying clutch CL2 is turned ON, the pull-out roller pair 2 and the second conveying roller pair 16*b* are rotated at the first conveying speed v. Incidentally, the first conveying speed v is equal to the rotational conveying speed of the sheet feeding roller 4. When the preceding sheet 14 transferred to the conveying portion 39 is conveyed by the pull-out roller pair 2, normally, the leading end of the sheet is detected by the detecting sensor 60 ("Y" in a step S104) before the value T of the timing measuring timer 72 exceeds a predetermined value T1 ("Y" in a step S103).

Incidentally, if the detecting sensor 60 is not turned ON ("N" in step S104) and, thus, if the value T of the timing measuring timer does not satisfy the relationship T≦T1 due to sheet feeding trouble or conveying trouble, i.e., if the value T exceeds the predetermined value T1 ("N" in step S103), it is judged as sheet jam, and the sheet feeding clutch CL1 and the conveying clutch CL2 are turned OFF (step S113) and rotations of motors are stopped (step S114), thereby finishing the conveying operation.

The value T1 is defined as T1=Tr+Tj by using a theoretical value Tr in which the leading end of the sheet is assumed to be theoretically detected by the detecting sensor 60 and a predetermined jam margin value Tj. Incidentally, the jam margin value Tj is determined in consideration of all conditions not to give serious damage to the image forming apparatus.

On the other hand, when the preceding sheet 14 is detected by the detecting sensor 60, the control device 70 starts the speed changing timer 71 (step S105). Further, low speed rotation (v) of the pulse motor PM for driving the first conveying roller pair 16*a* is started (step S106), thereby setting the sheet conveying speed of the first conveying roller pair 16*a* to the first conveying speed v.

As a result, the preceding sheet 14 detected by the detecting sensor 60 is firstly conveyed by the first conveying roller pair 16*a* at the first conveying speed v same as the pull-out roller pair 2. When the value t of the speed changing timer 71 becomes t3 to synchronize the sheet with the toner image on the photosensitive drum ("Y" in step S107), writing start command is sent to the laser scanner 35, thereby starting the image forming operation (step S108).

Figure 25:
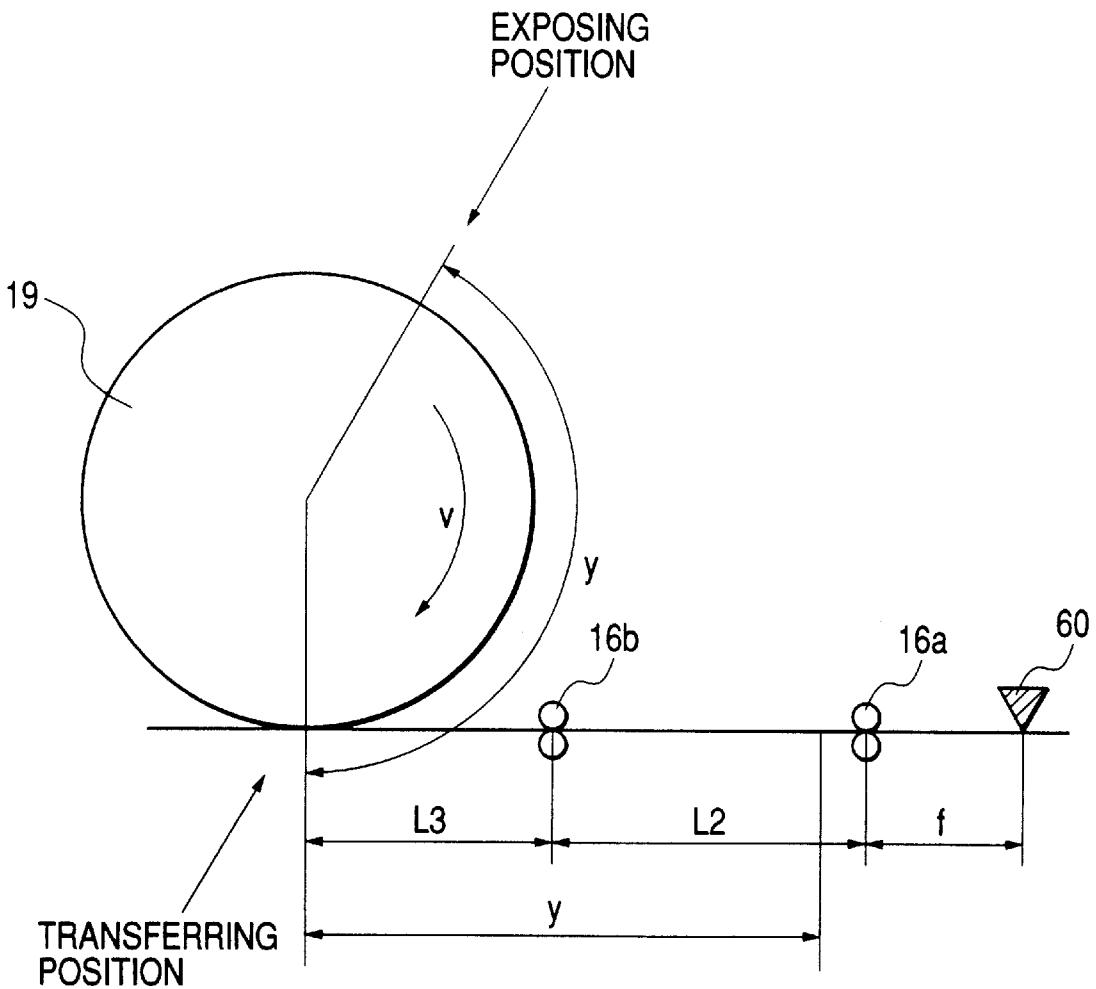
FIG. 25 is a view for explaining a writing position onto a photosensitive drum of the image forming apparatus.

Since a rotational peripheral speed of the photosensitive drum 19 is the same as the sheet conveying speed v, as shown in FIG. 25, when it is assumed that a distance from the image writing position on the photosensitive drum 19 to the image transferring position is y in a circumferential direction and a distance from the second conveying roller pair 16*b* to the transferring position is L3, the value t3 can be represented as follows:

$$t3=\theta+(L2+f-v\theta)/V+(L3-y)/v,\ (L2+f<v\theta) \quad (6)$$

$$t3=(L3+L2+f-y)/v,\ (L2+f\geqq v\theta) \quad (7)$$

Further, the image signal is recorded as the latent image on the photosensitive drum 19 by the laser beam emitted from the laser scanner 35, and the latent image is developed as the toner image in the image forming portion 17. Later, as described above, when the value t of the speed changing timer 71 becomes θ ("Y" in step S109), high speed rotation (V) of the pulse motor PM for driving the first conveying roller pair 16*a* is started (step S110), thereby changing the sheet conveying speed of the first conveying roller pair 16*a* to the second conveying speed V.

As a result, the trailing end of the preceding sheet 14 is accelerated and the sheet passes through the detecting sensor, thereby turning the detecting sensor OFF ("Y" in step S111). Incidentally, after the detecting sensor 60 is turned OFF in this way, if the sheet having the last number recognized by the controller (control device) is passed through the detecting sensor 60, it is judged that the passed sheet is a final sheet (last sheet).

If it is judged that the conveyed sheet is the last sheet ("Y" in step S112), the sheet feeding clutch CL1 and the conveying clutch CL2 are turned OFF (step S113) and the rotations of motors are stopped (step S114), thereby finishing the conveying operation. On the other hand, if it is judged that the conveyed sheet is not the last sheet "N" in step S112), the program is returned to the step S102, thereby continuing the sheet conveying task.

Incidentally, as shown in FIG. 24, the pulse motor PM is returned from the high speed conveyance (V) to the low speed conveyance (v) when the succeeding sheet reaches the detecting sensor 60 in the continuous conveying operation and is stopped upon completion of the task in case of the last sheet.

By the way, when the conveyance is continued, the succeeding sheet 15 conveyed by the pull-out roller pair 2 enters into the detecting sensor 60 which could detect the sheet by the passage of the trailing end of the preceding sheet 14 as mentioned above. As a result, even when there is no sheet interval, the leading end positions of the sheets can be detected during the continuous sheet feeding operation.

The conveyed sheet S is later conveyed by the second conveying roller pair 16*b* to be sent to the image transferring portion 18, where the toner image formed on the photosensitive drum 19 is transferred onto the sheet. By detecting the leading end of the sheet in this way and then by starting the image formation, it is possible to minimize positional deviation caused in the image transferring position.

Next, a first alteration of the illustrated embodiment will be explained.

In this alteration, the first conveying roller pair 16*a* is always rotated at the predetermined second conveying speed V. Incidentally, since the first conveying roller pair 16*a* is independently driven by the pulse motor PM and, thus, any number of revolutions can be set, in this alteration, at a time when a size of a sheet to be conveyed is recognized, the number of revolutions is determined in accordance with the sheet size.

By determining the number of revolutions in accordance with the sheet size in this way, if a sheet having larger size is conveyed at the same speed as that for the small size sheet, inconvenience such as formation of excessive loop can be prevented. Incidentally, in this case, since the loop amount δ is calculated in accordance with the following equation (8), the second conveying speed V is set to obtain substantially equal loop amount δ even if the sheet size L is changed:

$$\delta=(L-L2)(1-v/V) \quad (8)$$

Incidentally, when the preceding sheet 14 is conveyed by the first conveying roller pair 16*a* at the second conveying speed V in this way, in order to prevent the pulling between the first conveying roller pair and the pull-out roller pair 2, in this alteration, a one-way clutch is incorporated into the pull-out roller pair 2. With this arrangement, when the preceding sheet 14 is being conveyed by the first conveying roller pair 16*a*, the pull-out roller pair 2 is idly rotated by the sheet 14, thereby permitting the conveyance of the sheet at the second conveying speed V.

Incidentally, in this alteration, while an example that the conveying speed V of the first conveying roller pair 16*a* is changed minutely in accordance with the sheet size was explained, in dependence upon the construction of the above-mentioned upper guide plate 61, the first conveying roller pair may be designed to have only two speeds for large and small size sheets.

Figure 26:
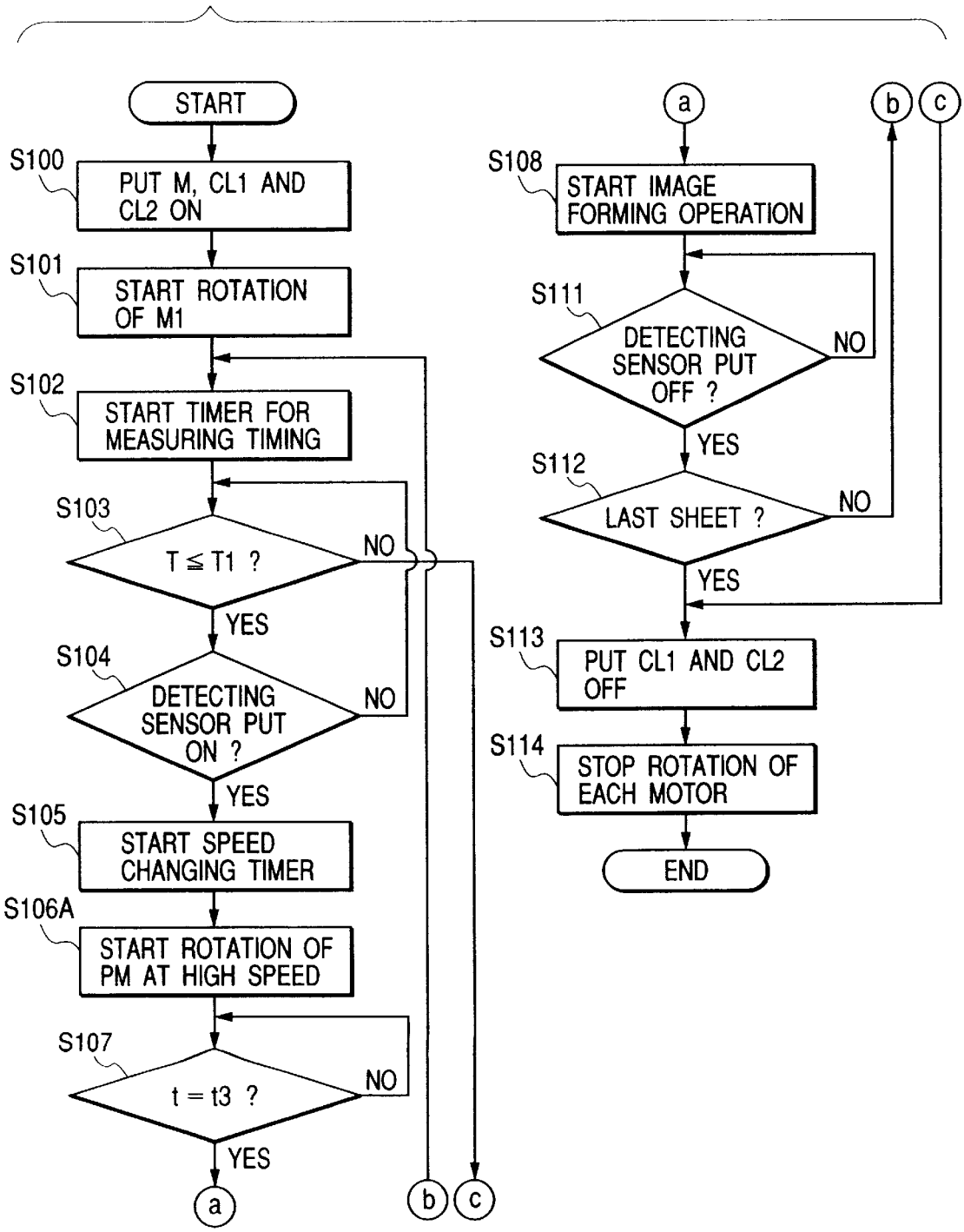
FIG. 26 is a flow chart for explaining an operation of a sheet conveying apparatus according to an alteration of the embodiment of the present invention.
Figure 27:
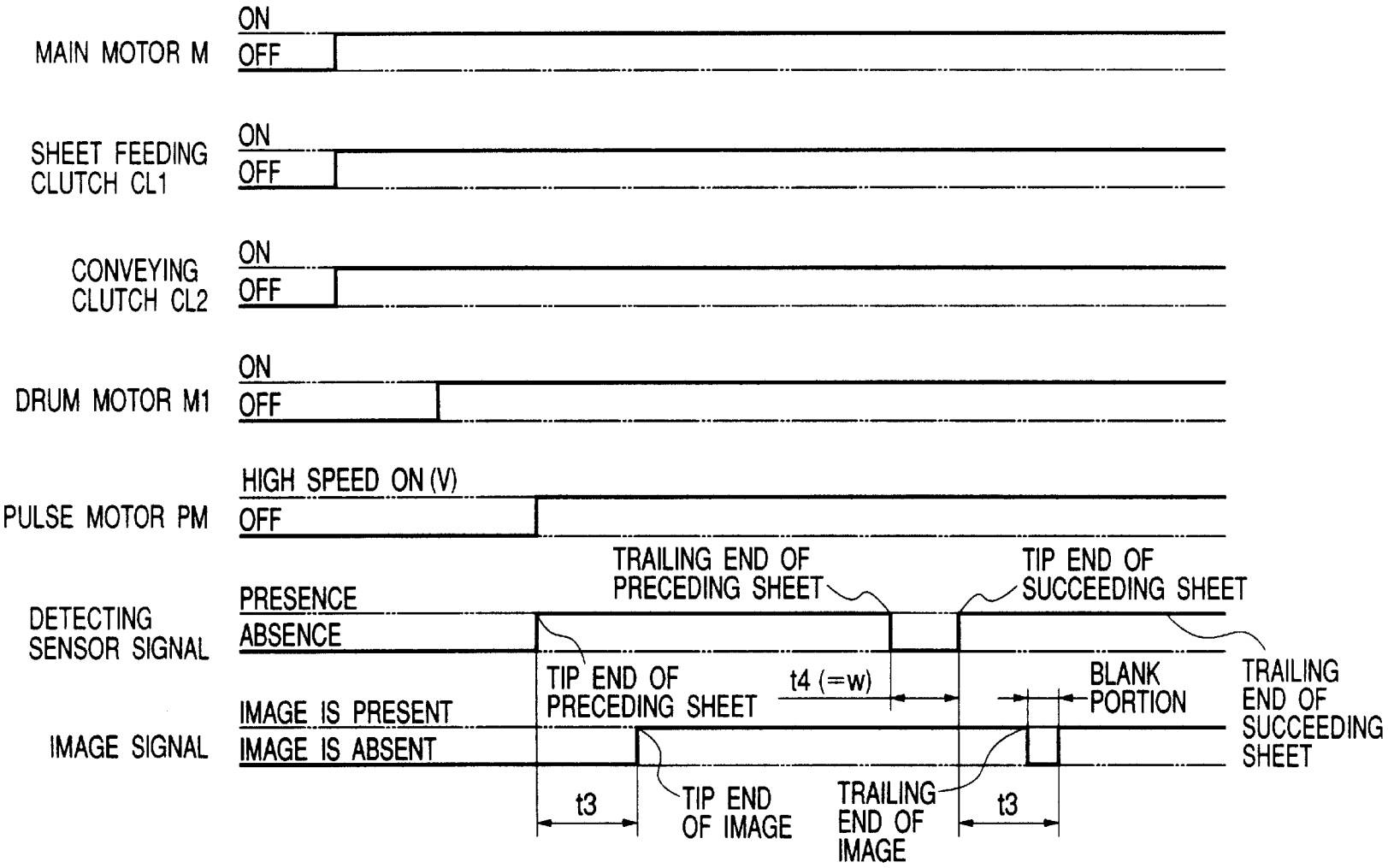
FIG. 27 is a timing chart for explaining an operation of the sheet conveying apparatus.

By the way, as mentioned above, although the sheets continuously conveyed are conveyed in the condition that the preceding sheet 14 and the succeeding sheet 15 are overlapped with each other by the action of the pick-up roller 3, further sheet conveying control will be explained with reference to a flow chart shown in FIG. 26 and a timing chart shown in FIG. 27.

In this alteration, at the same time when the leading end of the preceding sheet 14 is detected by the detecting sensor 60, the high speed rotation (V) of the pulse motor PM previously set in accordance with the sheet size is started (step S106A). As a result, the first conveying roller pair 16*a* starts to convey the sheet at the second conveying speed V previously determined in accordance with the sheet size.

When the sheet is conveyed at the second conveying speed V set in accordance with the sheet size in this way, the control for changing the sheet conveying speed can be omitted. Incidentally, since various processes before and after the rotation control of the pulse motor PM and other controls and the continuous sheet conveying condition are the same those associated with FIG. 22, explanation thereof will be omitted.

Next, another alteration of the above-mentioned embodiment will be described.

Figure 28:
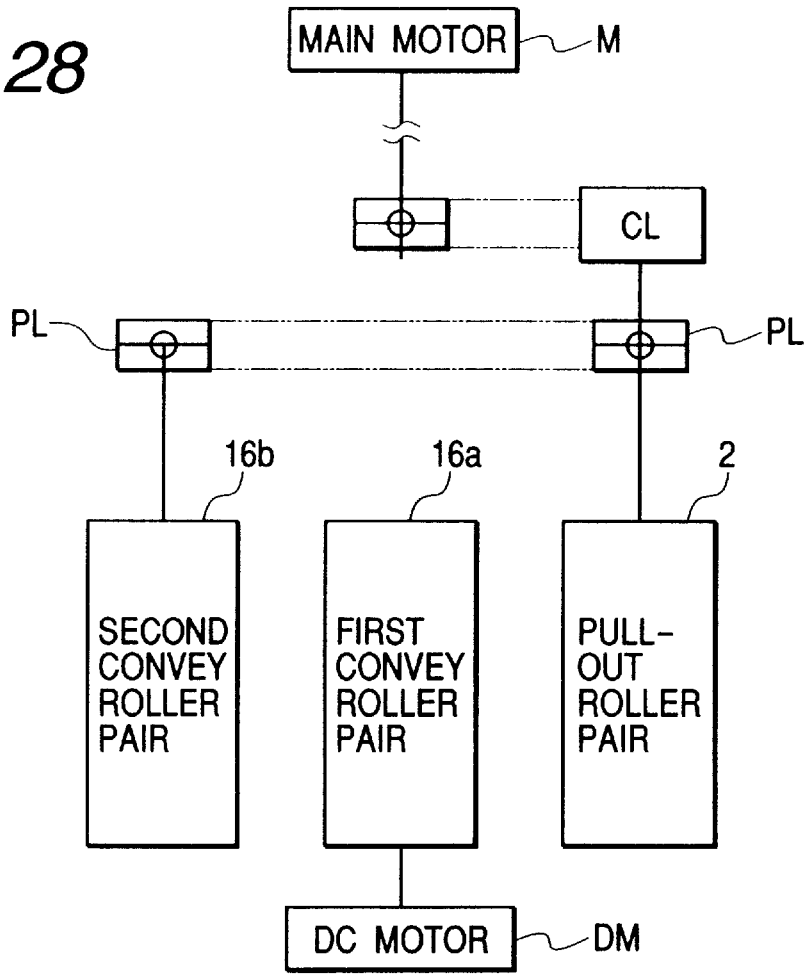
FIG. 28 is a block diagram of a driving system of a sheet conveying apparatus according to another alteration of the embodiment of the present invention.

FIG. 28 is a block diagram of a driving system of a sheet conveying apparatus according to another alteration. In this alteration, as shown in FIG. 28, the first conveying roller pair 16*a* is independently driven by a DC motor DM and is always rotated at a single second conveying speed v.

Figure 29:
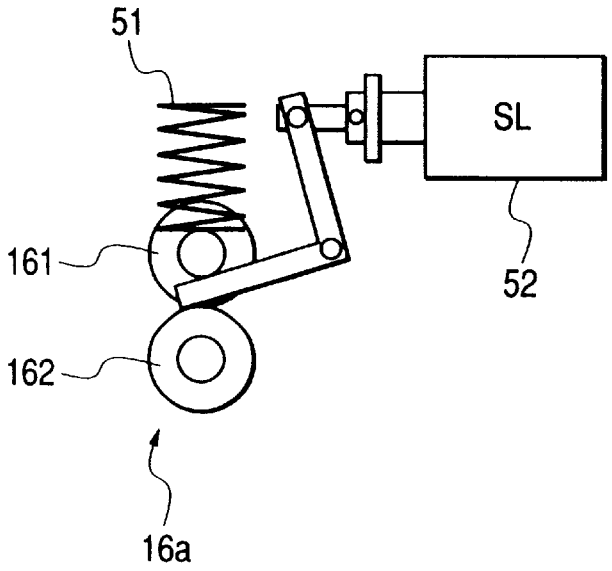
FIG. 29 is a view for explaining an arrangement in which a first conveying roller pair of the sheet conveying apparatus is disengaged and engaged.

Further, as shown in FIG. 29, the first conveying roller pair 16*a* can selectively be switched between a condition that one conveying roller 161 of the first conveying roller pair 16*a* is urged against the other roller 162 with predetermined pressure by the action of a pressing spring 51 to convey the sheet and a condition that the one conveying roller is disengaged from the other roller 162 by the action of a pressure releasing solenoid 52 not to convey the sheet.

At a time when a size of the sheet to be conveyed is recognized, a timing for engaging and disengaging the first conveying roller pair 16*a* is determined in accordance with the sheet size. With this arrangement, if a sheet having larger size is always conveyed at the same great speed as that for the small size sheet, excessive loop formed in the sheet by the first conveying roller pair 16*a* can be prevented.

By the way, in this alteration, the second conveying speed of the first conveying roller pair 16*a* is fundamentally determined in accordance with the small size sheet, and, when the large size sheet is conveyed, after the rollers of the first conveying roller pair 16*a* are disengaged from each other, by engaging the rollers of the first conveying roller pair with other again at the predetermined timing, substantially the same loop amount δ is created between the first and second conveying roller pairs 16*a* and 16*b*.

Incidentally, the timing η for engaging and disengaging the first conveying roller pair 16*a* is represented by the following equation (9), for example, by using the loop amount δ of the small size sheet calculated by the above-mentioned equation (4), a sheet conveying length Ls of the small size sheet, and a sheet conveying length L1 of the large size sheet:

$$\eta-(L1-Ls+f)/v \quad (9)$$

Incidentally, in this alteration, while an example that the first conveying roller pair 16*a* is disengaged upon conveyance of the large size sheet and is engaged upon conveyance of the small size sheet was explained, in dependence upon the kinds of sheets, there may be provided a plurality of engaging/disengaging timings so that the timing is switched in accordance with the sheet size.

Figure 30:
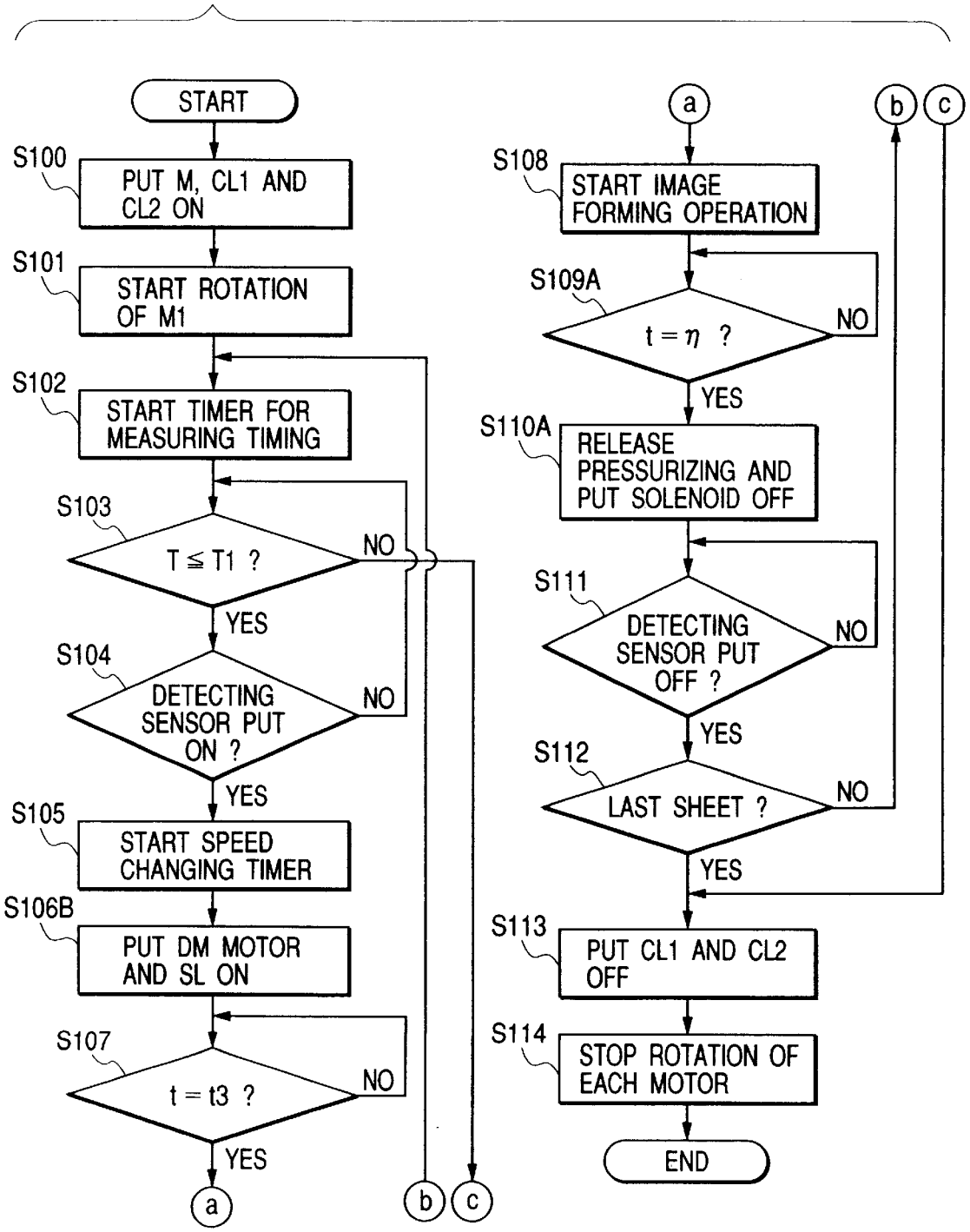
FIG. 30 is a flow chart for explaining an operation of the sheet conveying apparatus.
Figure 31:
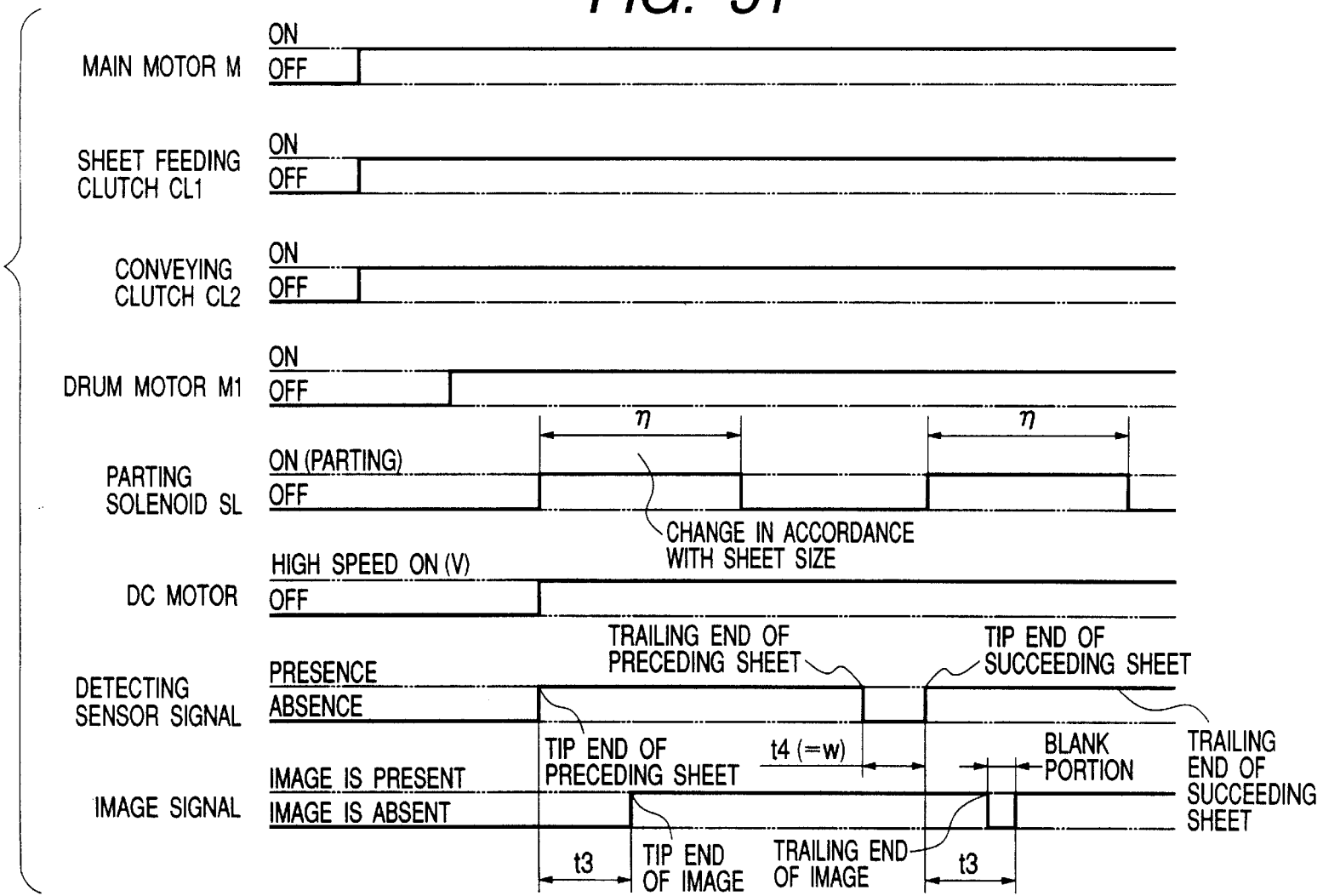
FIG. 31 is a timing chart for explaining the operation of the sheet conveying apparatus.
Figure 32:
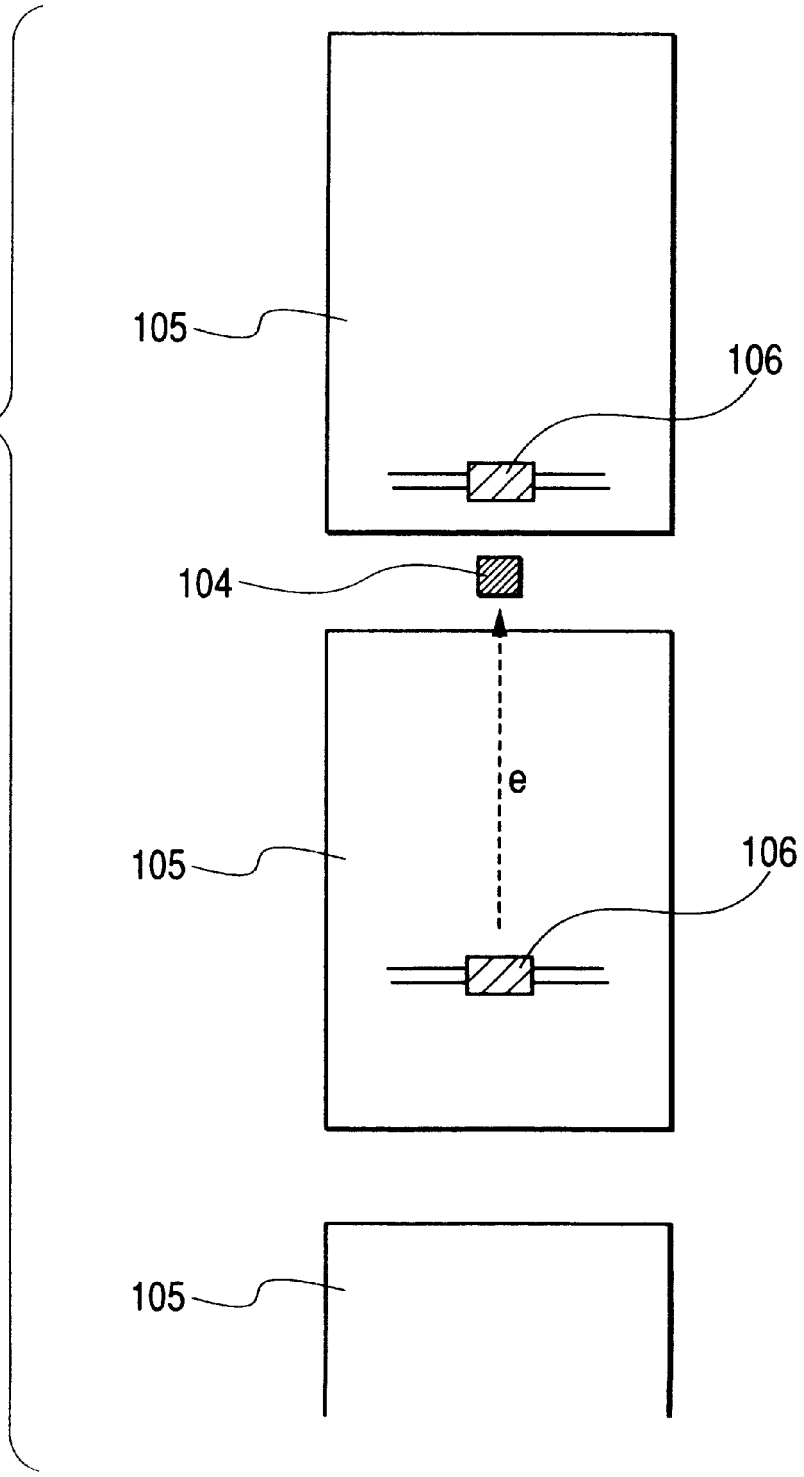
FIG. 32 is a schematic view of a conveying portion of a conventional sheet conveying apparatus.

By the way, also in this alteration, although the sheets continuously conveyed are conveyed in the condition that the preceding sheet 14 and the succeeding sheet 15 are overlapped with each other by the action of the pick-up roller 3, further sheet conveying control will be explained with reference to a flow chart shown in FIG. 30 and a timing chart shown in FIG. 31.

In this alteration, at the same time when the sheet is detected by the detecting sensor 60, the independently driving DC motor DM is rotated at a predetermined speed (step S106B). As a result, the first conveying roller pair 16*a* conveys the sheet at the predetermined second conveying speed V. Incidentally, when the sheet is conveyed at the second conveying speed V in this way, the control for switching the sheet conveying speed can be omitted.

Further, in this alteration, the timing η for engaging and disengaging the first conveying roller pair 16*a* is previously determined in accordance with the sheet size, and, when the value t of the speed changing timer 71 becomes η ("Y" in step S109A), the pressure releasing solenoid 52 is turned OFF (step S110A). As a result, the disengagement of the first conveying roller pair 16*a* is released, thereby conveying the sheet at the increased speed.

Incidentally, since various processed other than the rotation control of the DC motor DM and the engaging/disengaging control of the pressure releasing solenoid, and other controls and the continuous sheet conveying condition are the same those in the first alteration, explanation thereof will be omitted.

By the way, in the explanation of the above-mentioned embodiments, while an example that the conveyance is started in the condition that the trailing end of the preceding sheet is partially overlapped with the leading end of the succeeding sheet and the preceding sheet and the succeeding sheet are conveyed in such a manner that the sheet interval is created at the position of the detecting sensor was explained, the present invention may be designed so that the conveyance is started in a condition that the sheet interval between the preceding sheet and the succeeding sheet is zero (no gap) or in a condition that the detecting sensor cannot detect the sheet even when there is the gap and so that the sheet interval is created at the position of the detecting sensor. Further, in the above-mentioned embodiments, while an example that the image forming timing is determined by using the sheet conveying apparatus within the image forming apparatus was explained, the present invention is not limited to such an example, but, in the present invention, the sheet conveying apparatus may be incorporated into an image reading apparatus so that the number of originals is counted when the originals are conveyed to an image reading portion or an image reading timing is determined on the basis of the detection signal from the detecting means.

Further, in the present invention, the sheet conveying apparatus may be incorporated into a sheet processing apparatus (for example, sheet gathering apparatus) so that a timing for discharging sheets onto selected trays can be determined.

What is claimed is:

1. A sheet conveying apparatus for conveying sheets continuously, comprising:

detecting means for detecting each of the sheets to be conveyed; and conveying means for conveying the sheets;

wherein when the sheets are conveyed continuously, conveyance of a preceding sheet and a succeeding sheet is started in a condition that the succeeding sheet cannot be detected by said detecting means, and an interval which can be detected by said detecting means is created between the preceding sheet and the succeeding sheet at a position of said detecting means by said conveying means conveying the preceding sheet and the succeeding sheet at different conveying speeds.

2. A sheet conveying apparatus according to claim 1, wherein said conveying means includes first conveying means for conveying the sheet, and second conveying means disposed at a downstream side of said first conveying means and adapted to convey the sheet conveyed by said first conveying means, wherein said detecting means is disposed between said first conveying means and said second conveying means, and a second conveying speed of the sheet conveyed by said second conveying means is set to be greater than a first conveying speed of the sheet conveyed by said first conveying means so that a conveying speed difference is generated between the preceding sheet conveyed by said second conveying means and the succeeding sheet conveyed by said first conveying means, thereby creating the interval between the preceding sheet and the succeeding sheet at the position of said detecting means.

3. A sheet conveying apparatus according to claim 2, wherein said first conveying means is separating means for separating and feeding out the sheet contained in a sheet containing portion for containing the sheets, and said second conveying means is disposed at a downstream side of said separating means, and the conveyance of the preceding sheet and the succeeding sheet is started in a condition that the succeeding sheet cannot be detected by said detecting means, and said separating means and said second conveying means are driven to generate a conveying speed difference between the preceding sheet and the succeeding sheet, thereby creating the interval between the preceding sheet and the succeeding sheet at the position of said detecting means.

4. A sheet conveying apparatus according to claim 2, further comprising control means for controlling said second conveying means in such a manner that, when the preceding sheet is reached to said second conveying means and conveyed, the preceding sheet is conveyed at the first conveying speed of said first conveying means, and the preceding sheet is temporarily stopped at a predetermined position on a conveying path on the basis of detection information of said detecting means, and, when the preceding sheet is re-conveyed, said second conveying means conveys at the second conveying speed faster than the first conveying speed of said first conveying means.

5. A sheet conveying apparatus according to claim 3, wherein said separating means includes feeding means for feeding out the sheet from said sheet containing portion, a sheet feeding roller rotated in a sheet feeding direction along which the sheet fed out by said feeding means is fed, and a retard roller opposed to said sheet feeding roller and rotated in a direction opposite to the sheet feeding direction, so that the sheet directly sent by said sheet feeding roller is fed and a sheet moved together with said sheet and trying to pass through a nip portion between said sheet feeding roller and said retard roller is prevented from being fed.

6. A sheet conveying apparatus according to claim 5, wherein said sheet feeding roller of said separating means is provided with one-way connecting means for allowing a rotation of said sheet feeding roller in a feeding direction when a driving force to said sheet feeding roller is stopped, and wherein a feeding speed of the succeeding sheet by means of said feeding means is set to the first conveying speed.

7. A sheet conveying apparatus according to claim 6, wherein the conveyance is started by said separating means in a condition that a trailing end of the preceding sheet is partially overlapped with a tip end of the succeeding sheet, and the second conveying speed is set so that the interval is created between the preceding sheet and the succeeding sheet before the trailing end of the preceding sheet leaves said separating means.

8. A sheet conveying apparatus according to claim 7, wherein said feeding means and said separating means are driven by same driving means, and a driven speed is set to the first conveying speed.

9. A sheet conveying apparatus according to claim 5, wherein the first conveying speed for feeding out the sheet by said feeding means and said separating means is variable and is gradually increased after said feeding means starts the feeding of the sheets stacked in said sheet containing portion.

10. A sheet conveying apparatus according to claim 2, wherein said conveying means further comprises third conveying means disposed at a downstream of said second conveying means in a sheet conveying direction, wherein said third conveying means is set to convey the sheet at the first conveying speed.

11. A sheet conveying apparatus according to claim 10, further comprising control means for creating a loop in the preceding sheet between said second and third conveying means, thereby returning the spread interval between the sheets to an original condition.

12. A sheet conveying apparatus according to claim 11, wherein a pair of guide members for forming said sheet conveying path are provided between said second and third conveying means, and wherein one of said pair of guide members is provided with a curved portion for forming the loop in the sheet and the other of said pair of guide member is provided with a protruded portion for directing the sheet conveyed by said second conveying means toward said curved portion.

13. A sheet conveying apparatus according to claim 11, wherein the second conveying speed of said second conveying means is set by said control means in accordance with a size of the sheet to be conveyed to keep an amount $\delta$ of the loop substantially constant and the second conveying speed V satisfies a condition given by:

$$\delta=(L-L2)(1-v/V) \text{ and}$$

$$\delta= \text{a constant},$$

where L denotes the size of the sheet, v denotes the first conveying speed, V denotes the second conveying speed, and L2 denotes a distance between the second conveying means and the third conveying means.

14. A sheet conveying apparatus according to claim 2, wherein said second conveying means is capable of conveying the sheet at the first conveying speed and at the second conveying speed, and control means for switching the conveying speed from the first conveying speed to the second conveying speed on the basis of detection of the preceding sheet by said detecting means is provided.

15. A sheet conveying apparatus according to claim 14, wherein a timing $\theta$ for switching the conveying speed is changed by said control means in accordance with a size of the sheet to be conveyed and said timing $\theta$ is a time period from a time when the sheet is detected by said detecting means to a time when the conveying speed is switched, and said timing $\theta$ satisfies a condition given by:

$$(L-v\theta+w)/V<(L-v\theta-K)/v,$$

where L denotes the size of the sheet, v denotes the first conveying speed, V denotes the second conveying speed, w denotes a minimum plus sheet interval between the preceding sheet and the succeeding sheet, and K denotes an overlapping amount of the preceding sheet and the succeeding sheet.

16. A sheet conveying apparatus according to claim 14, wherein said second conveying means is switched between a condition that the sheet is conveyed and a condition that the sheet is not conveyed, and a timing for switching from the condition that the sheet is not conveyed, and a timing for switching from the condition that the sheet is conveyed to the condition that the sheet is not conveyed is changed in accordance with a size of the sheet to be conveyed.

17. A sheet conveying apparatus according to claim 2, wherein said first conveying means is provided with one-way connecting means for allowing rotation of said first conveying means when the sheet is pulled out by a conveying speed difference between said first conveying means and said second conveying means.

18. A sheet conveying apparatus according to claim 2, further comprising driving means for driving said first and second conveying means independently.

19. An image forming apparatus for forming an image on a sheet fed from a sheet conveying apparatus by means of image forming means, comprising:

detecting means for detecting each of the sheets to be conveyed; and said sheet conveying apparatus for conveying the sheets;

wherein when the sheets are conveyed continuously, conveyance of a preceding sheet and a succeeding sheet is started in a condition that the succeeding sheet cannot be detected by said detecting means, and an interval which can be detected by said detecting means is created between the preceding sheet and the succeeding sheet at a position of said detecting means by said sheet conveying apparatus conveying the preceding sheet and the succeeding sheet at different conveying speeds.

20. An image reading apparatus for reading an image on a sheet fed from a sheet conveying apparatus by means of image reading means, comprising:

detecting means for detecting each of the sheets to be conveyed; and said sheet conveying apparatus for conveying the sheets;

wherein when the sheets are conveyed continuously, conveyance of a preceding sheet and a succeeding sheet is started in a condition that the succeeding sheet cannot be detected by said detecting means, and an interval which can be detected by said detecting means is created between the preceding sheet and the succeeding sheet at a position of said detecting means by said sheet conveying apparatus conveying the preceding sheet and the succeeding sheet at different conveying speeds.

* * * * *

UNITED STATES PATENT AND TRADEMARK OFFICE

CERTIFICATE OF CORRECTION

PATENT NO. : 6,533,263 B2
DATED : March 18, 2003
INVENTOR(S) : Masashige Tamura

It is certified that error appears in the above-identified patent and that said Letters Patent is hereby corrected as shown below:

Title page,
Item [57], ABSTRACT,
Line 19, “a” should be deleted.

Column 4,
Line 2, “a” should be deleted.

Column 11,
Line 4, “here” should read -- there --.

Column 13,
Line 29, “a” should read -- an --.

Column 16,
Line 2, “sown” should read -- shown --.
Line 20, “sheet” should read -- sheets --.

Column 23,
Line 49, “processed” should read -- processes --.

Signed and Sealed this

Sixteenth Day of September, 2003

JAMES E. ROGAN
*Director of the United States Patent and Trademark Office*